US007536964B2

(12) United States Patent
Sadasue

(10) Patent No.: US 7,536,964 B2
(45) Date of Patent: May 26, 2009

(54) SEWING MACHINE

(75) Inventor: Kazuya Sadasue, Tokyo (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 12/055,749

(22) Filed: Mar. 26, 2008

(65) Prior Publication Data

US 2008/0236466 A1 Oct. 2, 2008

(30) Foreign Application Priority Data

Mar. 27, 2007 (JP) ..... 2007-082280

(51) Int. Cl.
*D05B 57/02* (2006.01)
*D05B 57/30* (2006.01)

(52) U.S. Cl. ..... 112/302; 112/199

(58) Field of Classification Search ..... 112/302, 112/192, 194, 197, 199, 200, 165, 166, 220
See application file for complete search history.

(56) References Cited

U.S. PATENT DOCUMENTS 3,333,560 A * 8/1967 Wiener et al. ..... 112/199
4,690,080 A * 9/1987 Mikuni et al. ..... 112/162
5,165,582 A * 11/1992 Andrews ..... 223/99
5,237,942 A * 8/1993 Satoma ..... 112/162
5,301,622 A * 4/1994 Sakuma ..... 112/162
5,327,841 A * 7/1994 Sakuma ..... 112/162
5,664,509 A * 9/1997 Tseng ..... 112/200
6,880,472 B2 * 4/2005 Horiuchi ..... 112/199

FOREIGN PATENT DOCUMENTS

JP 7-39668 2/1995
JP 2865470 12/1998

* cited by examiner

*Primary Examiner*—Ismael Izaguirre
(74) *Attorney, Agent, or Firm*—Drinker Biddle & Reath LLP

(57) ABSTRACT

A sewing machine includes an upper looper formed with a thread hole, an upper looper shaft which oscillates the upper looper between an upper position and a lower position, switching means operable to switch a coupled state and a decoupled state between the upper looper and the upper looper shaft, moving means for moving the upper looper, which has been decoupled from the upper looper shaft by the switching means, to the lower position, a thread guiding pipe formed with a thread discharging port, and first operating means operable to decouple the upper looper and the upper looper shaft via the switching means, and to move the thread discharging port of the thread guiding pipe to a position at which the thread discharging port is aligned with the thread hole of the upper looper in the lower position.

7 Claims, 16 Drawing Sheets

SEWING MACHINE

CROSS-REFERENCE TO RELATED APPLICATION(S)

The present application claims priority from Japanese Patent Application No. 2007-082280 filed on Mar. 27, 2007, the entire content of which is incorporated herein by reference.

FIELD OF THE INVENTION

The present invention relates to a sewing machine having a threading device for inserting threads through thread holes of upper and lower loopers, respectively.

BACKGROUND ART

Some sewing machines include a lower looper and an upper looper. The lower looper moves back and forth interlockingly with a vertical motion of a needle so as to be inserted into a loop of a needle thread formed below a throat plate. The upper looper is projectable above from the throat plate to insert an upper looper thread into a loop of a lower looper thread inserted in the loop of the needle thread by the lower looper. According to one technique, the sewing machine may be configured such that a use and a nonuse of the upper looper is selectable, so that a sewing work can be switched between a mode in which a sewing is carried out by a cooperation of the needle, the lower looper and the upper looper and another mode in which a sewing is carried out only by the needle and the lower looper without using the upper thread (see, e.g., JP 7-39668 A). This sewing machine includes a retracting mechanism operable to retract the upper looper to a lower position when the nonuse of the upper thread is selected. According to another technique, the sewing machine may include a threading mechanism which ejects compressed air toward thread holes at respective tip portions of the lower looper and the upper looper to insert the threads into the thread holes (see, e.g., Japanese Patent No. 2865470).

While the needle thread is caught by the lower looper or while the lower looper thread is caught the upper looper, threading the threads through the thread holes of the respective loopers is complicated, because the thread caught by the looper needs to be pulled and the order of inserting the threads needs to be considered. Further, if the threads are inserted through the thread holes of the loopers while the threads are caught by the respective loopers, the threads may not entangle with each other so that a seam may not be formed in a subsequent sewing work. Therefore, at the time of inserting the threads through the thread holes of the upper looper and the lower looper, it is preferable that the threads are not entangled with each other, namely, it is preferable that the needle is at its upper position, the lower looper is at its rear position and the upper looper is at its lower position. In other words, it is desirable that the threading mechanism is operable to retract the upper looper to the lower position while carrying out the threading.

It is desirable that both the retracting mechanism operable to retract the upper looper to the lower position when the upper looper is in nonuse and the threading mechanism operable to insert the thread (the upper looper thread) through the upper looper are incorporated into the sewing machine. However, if both of the mechanisms are incorporated into the sewing machine by combining the techniques disclosed in JP 7-39668 A and Japanese Patent No. 2865470, it is necessary to provide means for moving the upper looper to the lower position (i.e., the retracting position) for each of the mechanisms. Thus, a configuration becomes is very complicated and the number of components increases.

Moreover, according to the sewing machine disclosed in JP 7-39668 A, a switching operating portion for switching the use and nonuse of the upper looper is disposed on an inner side of a sewing machine cover. Therefore, the sewing machine cover needs to be opened in order to operating the switching operating portion. In addition, operability is poor because a working space is restricted inside the sewing machine cover.

SUMMARY OF THE INVENTION

One or more exemplary embodiments of the present invention provide a sewing machine in which a threading work through loopers and a switching operation for switching use and nonuse of an upper looper can be easily carried out.

According to one or more exemplary embodiments of the invention, a sewing machine includes an upper looper formed with a thread hole at a tip portion thereof and disposed so as to be oscillatable an upper looper shaft which oscillates the upper looper between an upper position and a lower position, switching means disposed in relation to the upper looper and the upper looper shaft such that the switching means is operable to switch a coupled state and a decoupled state between the upper looper and the upper looper shaft, moving means for moving the upper looper, which has been decoupled from the upper looper shaft by the switching means, to the lower position, a thread guiding pipe formed with a thread path through which an upper looper thread is insertable and having a thread discharging port, the thread guiding pipe being movable between a position, at which the thread discharging port is aligned with the thread hole of the upper looper in the lower position, and another position, at which the thread discharging port is moved away from the thread hole, and first operating means operable to decouple the upper looper and the upper looper shaft via the switching means, and to move the thread discharging port of the thread guiding pipe to the position at which the thread discharging port is aligned with the thread hole of the upper looper in the lower position.

Other aspects and advantages of the invention will be apparent from the following description, the drawings and the claims.

DETAILED DESCRIPTION

Hereinafter, exemplary embodiments of the invention will be explained with reference to the drawings. The following exemplary embodiments do not limit the scope of the invention.

In the following description, a Z-axis direction indicates a vertical direction (i.e., an up-and-down direction) of a sewing machine 1, a Y-axis direction indicates a longitudinal direction of an arm portion 2*a* (i.e., a right-and-left direction) of the sewing machine 1 in a state in which the sewing machine 1 is placed on a horizontal plane, and an X-axis direction indicates a front-and-rear direction parallel to a plate surface of a throat plate (not shown) and orthogonal to the Y-axis direction. The X-axis direction, the Y-axis direction and the Z-axis direction are orthogonal to each other.

First Exemplary Embodiment

Figure 1:
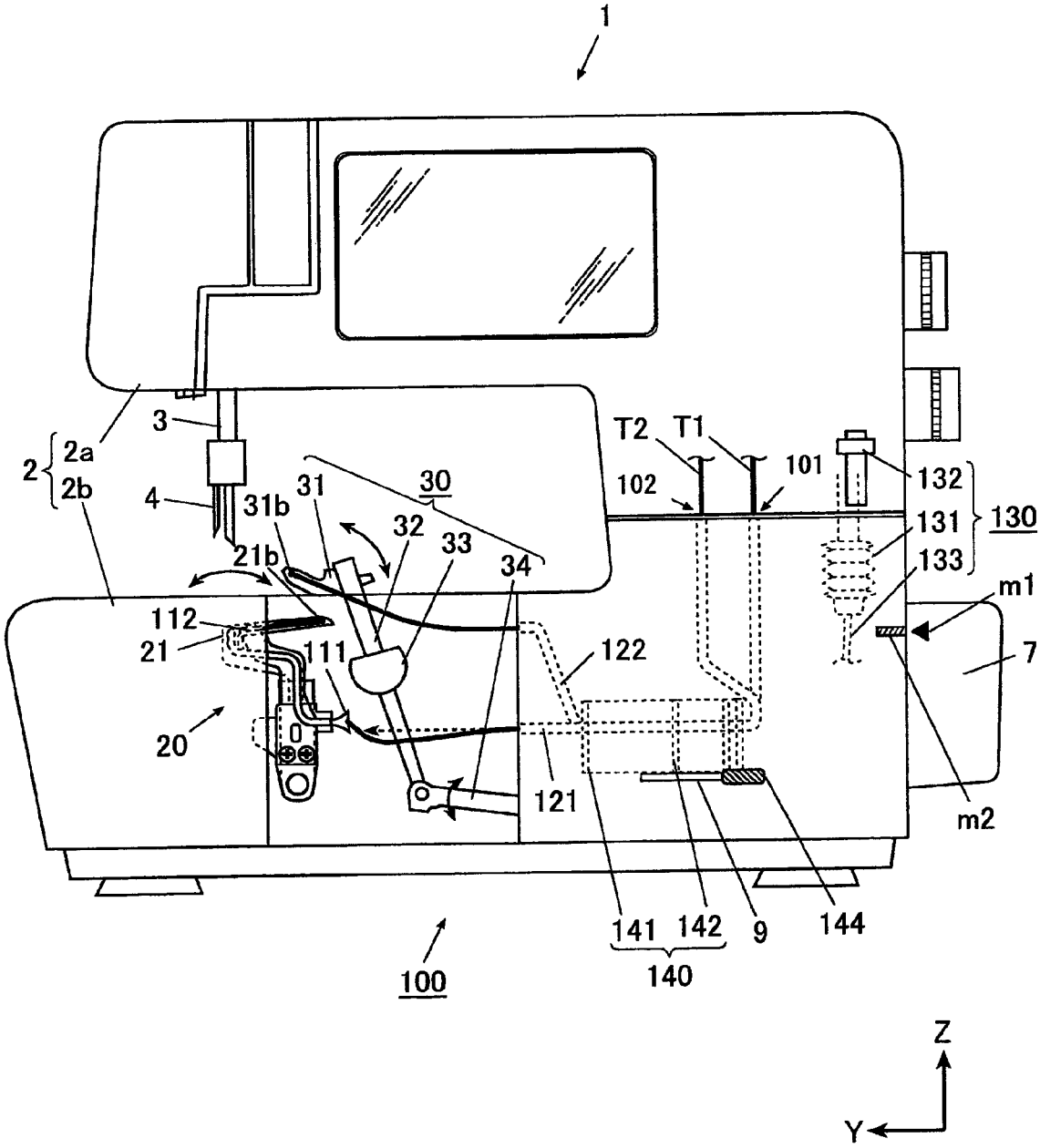
FIG. 1 is a schematic front view of a sewing machine according to a first exemplary embodiment of the invention.

FIG. 1 is a front view of the sewing machine 1 according to a first exemplary embodiment of the invention.

As shown in FIG. 1, the sewing machine 1 includes a needle driving mechanism (not shown) which drives a needle 4 in the vertical direction by means of a sewing machine motor (not shown), a lower looper driving mechanism 20 and an upper looper driving mechanism 30 which cooperate with the needle 4 to form a seam, a threading device 100 for inserting a lower looper thread T1 and an upper looper thread T2 through thread holes 21*b*, 31*b* at tip portions of a lower looper 21 of the lower looper driving mechanism 20 and an upper looper 31 of the upper looper driving mechanism 30 respectively, and an upper looper use/nonuse switching mechanism 190 for switching a use and a nonuse of the upper looper 31. Each of the portions will be described below in detail.

[Needle Driving Mechanism]

The needle driving mechanism includes an upper shaft (not shown) rotated by the sewing machine motor, and a vertical motion transmitting mechanism which converts a rotation of the upper shaft into a reciprocating vertical motion through a rotating weight and a crank rod and transmits the reciprocating vertical motion to a needle bar 3. The needle 4 is held at a lower end portion of the needle bar 3. When the upper shaft is rotated by driving the sewing machine motor, the vertical motion is applied to the needle bar 3 through the vertical motion transmitting mechanism, whereby the needle bar 3 and the needle 4 reciprocate between upper and lower positions

[Lower Looper Driving Mechanism]

Figure 2:
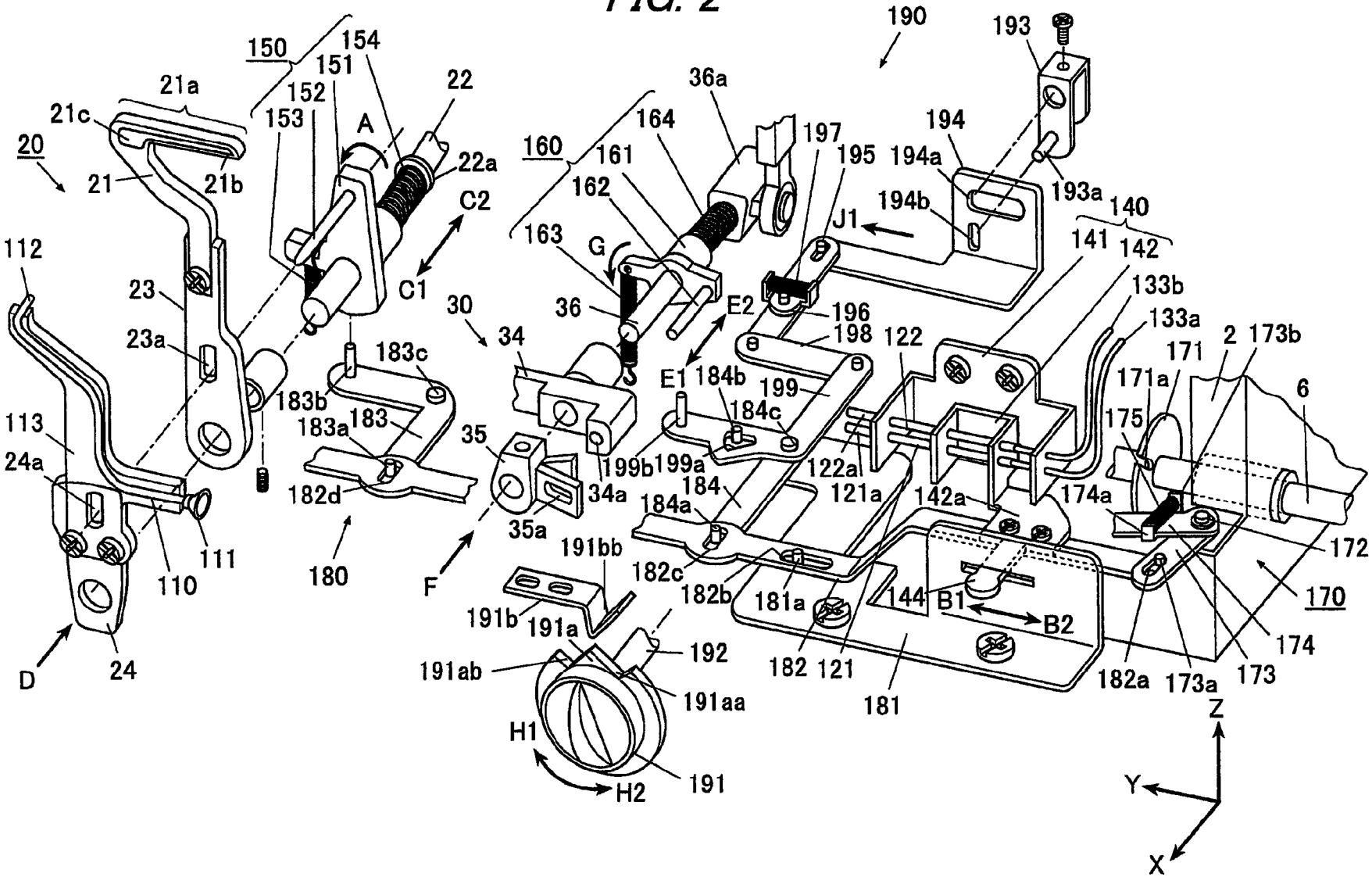
FIG. 2 is a exploded perspective view of a threading device and an upper looper use/nonuse switching mechanism according to the first exemplary embodiment.

The lower looper driving mechanism 20 is disposed below the throat plate (not shown). As shown in FIG. 2, the lower looper driving mechanism 20 includes a lower looper shaft 22 rotatably supported in a bed portion 2*b* along the X-axis direction, a rotation transmitting mechanism (not shown) branched from a lower shaft 6 (a main shaft) to convert a rotational force of the lower shaft 6 into a reciprocating rotational force and to transmit the reciprocating rotational force to the lower looper shaft 22, a lower looper driving arm 24 fixed to a tip portion of the lower looper shaft 22 and oscillates around the lower looper shaft 22, a lower looper support arm 23 which can be coupled to and decoupled from the lower looper driving arm 24, and a lower looper 21 held at an oscillating end portion of the lower looper support arm 23.

The rotational force around the X-axis is applied from the lower shaft 6 extending in the Y-axis direction to the lower looper shaft 22 through the rotation transmitting mechanism, whereby the lower looper shaft 22 carries out a reciprocating rotation in synchronization with the rotation of the lower shaft 6. The lower looper shaft 22 oscillates the lower looper 21 and a thread conduit 110 between front and rear positions, respectively.

The lower looper driving arm 24 is formed with a slot 24*a* through which a release pin 152 of a first switching mechanism 150 is insertable in the X-axis direction. The slot 24*a* extends in a vertical direction on an upper side of a coupling portion to the lower looper shaft 22. The lower looper driving arm 24 is oscillated by the rotation of the lower looper shaft 22. A thread guide plate 113 supporting the thread conduit 110 is detachably attached to the lower looper driving arm 24.

The lower looper support arm 23 is rotatably coupled to the lower looper shaft 22 on a side of the lower looper driving arm 24. The lower looper support arm 23 is formed with a slot 23*a* through which the release pin 152 is insertable in the X-axis direction. The slot 23*a* extends in the vertical direction on an upper side of a coupling portion to the lower looper shaft 22 where it corresponds to the slot 24*a* of the lower looper driving arm 24.

The lower looper 21 has an extended portion 21*a* which moves back and forth in synchronization with the vertical motion of the needle 4 so as to be inserted into a loop of a needle thread. A tip portion of the extended portion 21*a* is formed with a thread hole 21*b* through which the lower looper thread T1 discharged from a thread discharging port 112 of the thread conduit 110 is inserted. The extended portion 21*a* is further formed with a looper groove 21*c* extending from the thread hole 21*b* along a portion corresponding to the thread discharging port 112. When the lower looper shaft 22 interlocking with the sewing machine motor is rotated so that the lower looper driving arm 24 and the lower looper support arm 23 are oscillated, the lower looper 21 moves below the throat plate so as to pass a rear side in the vicinity of a moving path of the needle 4, thereby catching the loop of the needle thread inserted through the needle 4 at the lower position and inserting a loop of the lower looper thread T1 into the loop of the needle thread.

[Upper Looper Driving Mechanism]

As shown in FIGS. 1 and 2, the upper looper driving mechanism 30 includes the upper looper 31 having the thread hole 31*b* at a tip portion thereof and is insertable into the loop of the lower looper thread T1 inserted into the loop of the needle thread to entangle the upper looper thread T2 with the needle thread and the lower looper thread T1, an upper looper holding member 32 holding the upper looper 31, a support member 33 supporting the upper looper holding member 32 so as to allow the upper looper holding member 32 to carry out a linear motion and rotations around two axes, an upper looper support arm 34 coupled to the upper looper holding member 32 and operable to reciprocate a coupling point to the upper looper holding member 32 between two positions, an upper looper shaft 36 rotatably supporting one end of the upper looper support arm 34, a rotation transmitting mechanism (not shown) which is branched from the lower shaft 6 to convert a rotational force of the lower shaft 6 into a reciprocating rotational force and to transmit the reciprocating rotational force to the upper looper shaft 36, and an upper looper oscillating arm 35 fixed to the upper looper shaft 36 and applies an oscillating force to the upper looper support arm 34.

The rotational force around the X-axis is applied from the lower shaft 6 to the upper looper shaft 36 through the rotation transmitting mechanism, whereby the upper looper shaft 36 carries out a reciprocating rotation in synchronization with the rotation of the lower shaft 6. The upper looper shaft 36 oscillates the upper looper 31 between upper and lower positions.

The upper looper oscillating arm 35 is formed with a slot 35*a* through which a release pin 162 of a second switching mechanism 160 is insertable in the X-axis direction. The slot 35*a* is formed on a right side of a coupling portion to the upper looper shaft 36 when seen in a direction F shown in FIG. 2. The upper looper oscillating arm 35 is oscillated by the rotation of the upper looper shaft 36.

The upper looper oscillating arm 34 has one end rotatably coupled to the upper looper shaft 36 on a side of the upper looper oscillating arm 35. The upper looper support arm 34 has a hole 34*a* through which the release pin 162 is insertable in the X-axis direction. The hole 34*a* is formed on a right side of a coupling portion to the upper looper shaft 36 when seen in the direction F where it corresponds to the slot 35*a* of the upper looper oscillating arm 35.

The upper looper holding member 32 is a round bar member, and has one end (an upper end) portion holding the upper looper 31 and a lower end portion coupled to the other end of the upper looper support arm 34 so as to be rotatable around the X axis. The upper looper holding member 32 is held by the support member 33 supported such that the upper looper holding member 32 is oscillatable in a direction orthogonal to the X-axis direction and such that the upper looper holding member 32 is slidable in a longitudinal direction thereof. The support member is supported in the upper looper holding member 32 so as to be rotatable around the X-axis direction.

The upper looper 31 is arcuately reciprocated in the vertical direction by the rotation of the upper looper shaft 36 through the upper looper oscillating arm 35, the upper looper support arm 34 and the upper looper holding member 32. More specifically, the upper looper 31 moved between an upper position (i.e., one moving end of its vertical reciprocation) at which the upper looper 31 projects from an inner side of the bed portion 2*b* above the throat plate and a lower position (i.e., the other moving end of its vertical reciprocation) at which the upper looper 31 is moved downward inside the bed portion 2*b*. The tip portion of the upper looper 31 is formed with the thread hole 31*b* through which the upper looper thread T2 is inserted in the X-axis direction. The upper looper 31 passes a rear side of a moving path of the lower looper 21, whereby the upper looper 31 is inserted into the loop of the lower looper thread T1 inserted through the loop of the needle thread to insert the upper looper thread T2 into the loop of the lower looper thread T1. The tip portion of the upper looper 31 is moved to a stitch point of the needle 4, whereby the needle 4 and the needle thread is inserted through a loop of the upper looper thread T2 to form a seam.

As shown in FIG. 1, a flywheel 7 is fixed to one end of the lower shaft 6 extending out from a sewing machine frame 2 such that the flywheel 7 and the lower shaft 6 are rotatable together. A mark m1 is provided on an edge portion of the flywheel 7, and a mark m2 is provided on an edge portion of the sewing machine frame 2 near the mark m1. The mark m1 of the flywheel 7 becomes coincident with the mark m2 of the sewing machine frame 2 when the lower shaft 6 is positioned at a predetermined rotating angle. More specifically, the predetermined rotating angle may be an angle of the lower shaft 6 at which the lower looper 21 oscillatable in synchronization with the rotation of the lower shaft 6 is disposed at one oscillating end, i.e., at a foremost position (a front position) of the back-and-forth movement of the lower looper 21. Further, when the he lower shaft 6 is positioned at the predetermined rotating angle, i.e., when the mark m1 of the flywheel 7 is coincident with the mark m2 of the sewing machine frame 2, the needle 4 and the upper looper 31 are disposed their respective upper positions (e.g., see FIG. 6).

[Threading Device]

As shown in FIG. 1, the threading device 100 is provided inside the bed portion 2*b*. The threading device 100 guides the lower looper thread T1 and the upper looper thread T2 led through thread inserting portions 101 and 102 from outside the sewing machine frame 2 to the thread hole 21*b* of the lower looper 21 and to the thread hole 31*b* of the upper looper 31, respectively.

Figure 5:
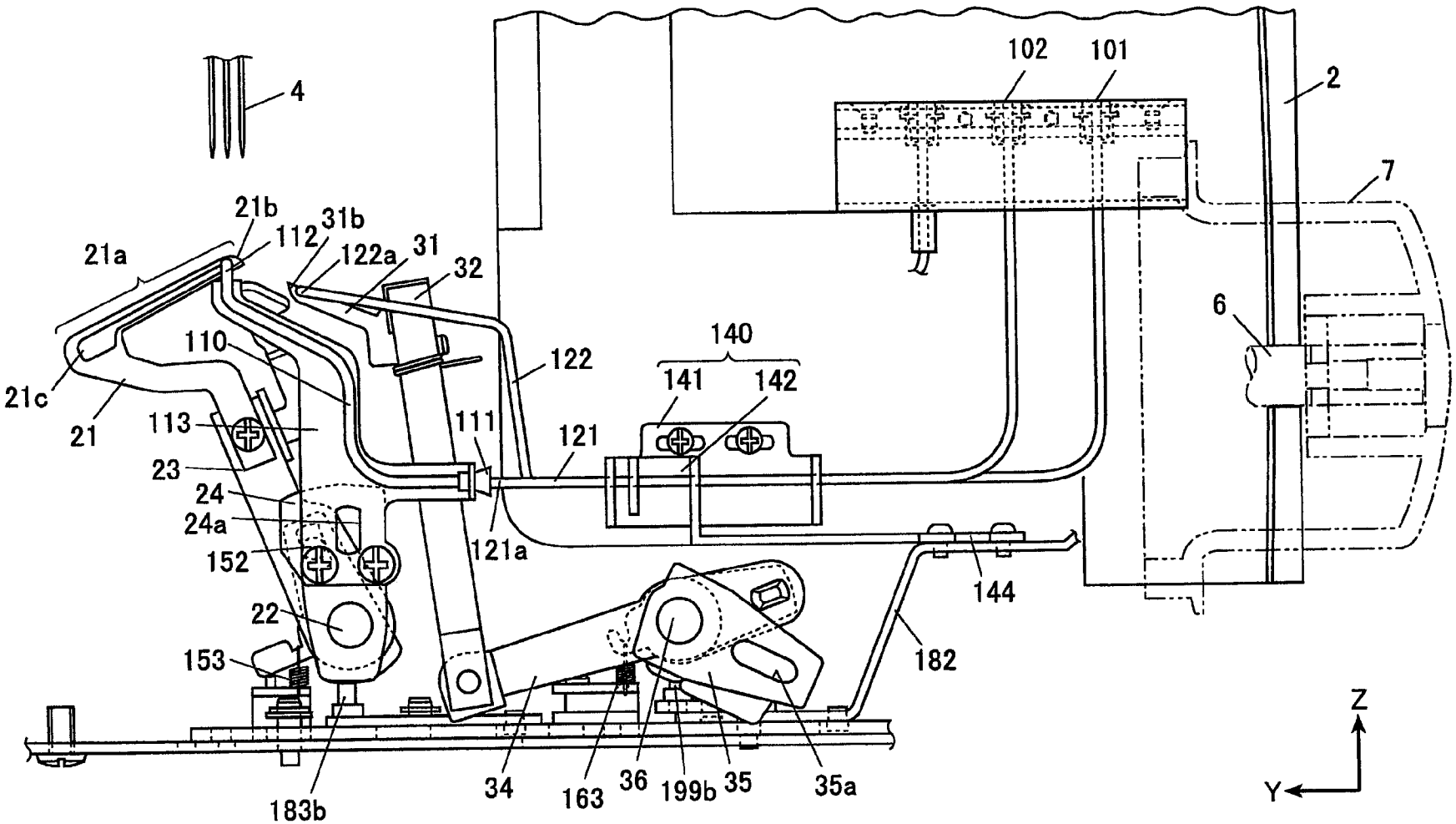
FIG. 5 is an explanatory view showing an operation (between a threading position and a blowing position) of the threading device.

As shown in FIGS. 1 and 2, the threading device 100 includes the thread conduit 110 having one end serving as a thread inserting port 111, the other end serving as the thread discharging port 112, and a thread path through which the lower looper thread T1 is insertable inside the thread conduit 110, an air ejecting unit (air supplying means) operable to forwardly move thread guiding pipes 121, 122 to blowing positions (see FIG. 5) opposing the thread inserting port 111 of the thread conduit 110 and the thread hole 31*b* of the upper looper 31 respectively to eject air against the thread inserting port 111 and the thread hole 31*b*, a first switching mechanism 150 (first switching means) operable to switch a coupling and a decoupling between the lower looper 21 and the lower looper shaft 22 when the lower looper is at a front position, a first spring 153 (first moving means) operable to move the lower looper 21 to a rear position when the lower looper 21 is decoupled from the lower looper shaft 22 by the first switching mechanism 150, a second switching mechanism 160 (second switching means) operable to switch a coupling and a decoupling between the upper looper 31 and the upper looper shaft 36, a second spring 163 (second moving means) operable to move the upper looper 31 to a lower position when the upper looper 31 is decoupled from the upper looper shaft 36 by the second switching mechanism 160, a main shaft locking mechanism 170 operable to position the lower shaft 6 at the predetermined rotating angle so that the thread conduit 110 is positioned at a front position via the lower looper shaft 22, and an interlocking mechanism 180 (interlocking means) operable to move the thread guiding pipes 121, 122 to the respective blowing positions, bring both the first and second switching mechanisms 150, 160 into a decoupling state, and bring the main shaft locking mechanism 170 into an operable state.

As shown in FIGS. 1 and 2, the thread conduit 110 is a tubular member, and is formed substantially in a S-shape when seen from a side. The thread conduit 110 and has one end serving as the thread inserting port 111 into which the lower looper thread T1 is insertable and the other end serving as the thread discharging port 112 from which the lower looper thread T1 is dischargable. A diameter of the thread inserting port 111 is gradually increased toward the end in order to easily insert the lower looper thread T1. The other end of the thread conduit 110, i.e., the thread discharging port 112, is bent toward the lower looper 21. During a stitching work, the thread discharging port 112 is disposed on a rear end of the thread groove 21*c* of the lower looper 21, i.e., a side opposite to the needle hole 21*b* in the extended portion 21*a* of the lower looper 21. The thread conduit 110 is fixed to a side surface of the thread guide plate 113. The thread conduit 110 is oscillated together with the lower looper 21 via the thread guide plate 113, the lower looper driving arm 24 and the lower looper support arm 23 during the sewing work to reciprocate between front and rear positions. In the first exemplary embodiment, the front position is a threading position of the thread conduit 110 (see FIG. 5).

The air ejecting unit includes the thread guiding pipes 121, 122 from which the air is ejected toward the thread inserting port 111 and the thread hole 31*b* respectively, an air pump 130 operable to supply the air to the thread guiding pipes 121, 122, and a moving mechanism 140 operable to move the thread guiding pipes 121, 122 between the respective blowing positions, which are close to the thread inserting port 111 and the thread hole 31*b* (see FIG. 5), and standby positions, which are moved away from the blowing positions (see FIG. 1).

Each of the thread guiding pipes 121, 122 has one end opened toward a working position of an operator at a vertical drum portion coupling the bed portion 2*b* and the arm portion 2*a*, and serves as the thread inserting port 101, 102 into which the lower looper thread T1 and the upper looper thread T2 are led from the outside of the sewing machine, respectively. Inner sides of the thread guiding pipes 121, 122 serve as thread paths through which the lower looper thread T1 and the upper looper thread T2 are inserted separately. The other end of each of the thread guiding pipes 121, 122 serves as a blowing port 121*a*, 122*a* (a thread discharging port) for inserting the thread into the thread inserting port 111 and the thread hole 31*b*, respectively.

As shown in FIG. 1, the air pump 130 includes an extensible and hollow bellows portion 131 and a lever portion 132 coupled to one end of the bellows portion 131. The lever portion is for compressing the bellows portion 131. The other end of the bellows portion 131 is coupled to the thread guiding pipes 121, 122 via an air tube 133 and an air nozzle (not shown). When the lever portion 132 is operated so that the bellows portion 131 is compressed, the air pump 130 feeds the air inside the bellows portion 131 to the thread guiding pipes 121, 122 through the air tube 133 and the air nozzle, thereby blowing the lower looper thread T1 and the upper looper thread T2 by the compressed air from the blowing ports 121*a*, 122*a* at the tips (the other ends) of the thread guiding pipes 121, 122.

As shown in FIG. 2, the moving mechanism 140 includes an operating plate 142 holding the thread guiding pipes 121, 122 in the Y-axis direction, and a support base 141 fixed to the sewing machine frame 2 and movably supporting the thread guiding pipes 121, 122. The which thread guiding pipes 121, 122 are movable in the Y-axis direction together with the operating plate 142, between the blowing positions and the standby positions respectively.

The support base 141 is a frame member having a C-shape when seen in a plan view, and is fixed inside the bed portion 2*b* with screws as shown in FIG. 2. Right and left end portions of the support base 141 are bent substantially at right angles toward a front side of the sewing machine 1 (i.e., a front side of the paper in FIG. 1) which is a side of the working position of the operator, and are extended in parallel to each other.

The operating plate 142 has a bent portion 142*a* at one end (a lower end) thereof. The bent portion 142*a* is bent toward the front side of the sewing machine 1, which is the side of the working position of the operator. The bent portion 142*a* has a threading lever 144 (first operating means) at a tip portion thereof. The threading lever is protruded toward the side of the working position of the operator from a lever groove 9 formed on a front surface of the sewing machine frame 2 in the Y-axis direction. The threading lever 144 is engaged through the lever groove 9 so as to be movable in the Y-axis direction, thereby allowing the operator to move the air ejecting unit in the Y-axis direction between the standby position and the blowing position by operating the threading lever 144. A release link 182 of the interlocking mechanism 180 is coupled to the bent portion 142*a* (see FIG. 2). Thus, the operator can manually operate the interlocking mechanism 180 via the threading lever 144 to bring the first and second switching mechanisms 150, 160 into a decoupling state, to move the thread guiding pipes 121, 122 to the blowing positions thereby aligning the blowing port 122*a* with the thread hole 31*b* of the upper looper 31 positioned at the lower position, and to bring the main shaft locking mechanism 170 into an operable state.

As shown in FIG. 2, the first switching mechanism 150 includes a release slide base 151 through which the lower looper shaft 22 is inserted, the release pin 152 (a first coupling member) protruding from one end surface of the release slide base 151 and slidable to couple the lower looper support arm 23 and the lower looper driving arm 24 when both the lower looper 21 and the thread conduit 110 are positioned at their rear positions, and a coil spring 154 biasing the release slide 151 in an axial direction of the lower looper shaft 22.

The release slide base 151 is provided on an opposite side to the lower looper driving arm 24 with the lower looper support arm 23 interposed therebetween, and is rotatably coupled to the lower looper shaft 22 so as to be movable in the axial direction of the lower looper shaft 22. The release pin 152 is protruded from the end surface of the release slide base 151 on a side of the lower looper support arm 23. The release slide base 151 includes a spring hook portion to which the first spring 153 is attached. The spring hook portion is provided on a left end portion of the release slide base 151 when seen in a direction D shown in FIG. 2. A protrusion 183*b* of a driving link 183 of the interlocking mechanism 180 is movable in the X-axis direction so as to contact or to move away from a lower end portion of the release slide base 151. When the protrusion 183*b* is moved in a direction C2, a moving force in the C2 direction is applied to the release slide base 151.

The release pin 152 is provided on an upper side of the lower looper shaft 22 when seen in the direction D shown in FIG. 2, and is protruded parallel to the lower looper shaft 22 from the end surface of the release slide base 151 toward the lower looper support arm 23. A length of the release pin 152 is set such that a tip of the release pin 152 is inserted into the slot 24*a* of the lower looper driving arm 24 through the slot 23*a* of the lower looper support arm 23 in a state in which the end surface of the release slide base 151 is in contact with the lower looper support arm 23, and such that the release pin 152 is disengaged from the lower looper driving arm 24 and is engaged only with the lower looper support arm 23 when the release slide base 151 is slid in the direction C2 by the interlocking mechanism 180. Accordingly, the release pin 152 is operable to switch a coupling and a decoupling between the lower looper support arm 23 and the lower looper driving arm 24, thereby switching an interlock and a release between the lower looper shaft 22 and the lower looper 21.

The coil spring 154 is externally provided on the lower looper shaft 22 on a side opposite to the lower looper support arm 23 with the release slide base 151 interposed therebetween. The coil spring 154 has one end engaged with the other end surface of the release slide base 151 and the other end engaged with an end face of a flange 22*a* fixed to the lower looper shaft 22. The coil spring constantly biases the release slide base 151 toward the lower looper support arm 23 (in a direction C1 shown in FIG. 2).

The first switching mechanism 150 couples the lower looper 21 and the lower looper shaft 22 when the release slide base 151 is positioned on a side of the direction C1 so that the release pin 152 is inserted into the slot 23*a* of the lower looper support arm 23 and the slot 24*a* of the lower looper driving arm 24, while switches the lower looper 21 and the lower looper shaft 22 into a decoupled state when the release slide base 151 is positioned on a side of the direction C2 so that the lower looper driving arm 24 is decoupled from the lower looper support arm 23.

The first spring 153 has one end (an upper end) coupled to the spring hook portion of the release slide base 151 on the left side of the lower looper shaft 22 when seen in the direction D shown in FIG. 2, and the other end (a lower end) coupled to an inner bottom surface of the bed portion 2*b*. The first spring 153 is a tension spring, and constantly biases the release slide base 151 in one rotating direction around the lower looper shaft 22, i.e., a rearward moving direction of the lower looper 21 (a direction A shown in FIG. 2). When the lower looper 21 and the lower looper shaft 22 are brought into a decoupled state through the first switching mechanism 150, the first spring 153 moves the lower looper 21 to a rearmost position (a rear position) in the back and forth movement via the release slide base 151, the release pin 152 and the lower looper support arm 23. In the first exemplary embodiment, when the lower looper 21 is tilted at the rear position, the thread hole 21*b* of the lower looper 21 is coincident with the thread discharging port 112 of the thread conduit 110 positioned at the front position. Namely, the rearmost position of the lower looper 21 is a threading position of the lower looper 21 (see FIG. 5).

As shown in FIG. 2, the second switching mechanism 160 includes a release slide base 161 through which the upper looper shaft 36 is inserted, the release pin 162 (a second coupling member) protruding from one end surface of the release slide base 161 and slidable to couple the upper looper support arm 34 and the upper looper oscillating arm 35, and a coil spring 164 biasing the release slide base 161 in an axial direction of the upper looper shaft 36.

The release slide base 161 is provided on an opposite side to the upper looper oscillating arm 35 with the upper looper support arm 34 interposed therebetween. The release slide base 161 is rotatably coupled to the upper looper shaft 36 so as to be movable in the axial direction of the upper looper shaft 36. The release pin 162 is protruded from the end surface on a side of the upper looper support arm 34. The release slide base 161 includes a spring hook portion to which the second spring 163 is attached. The spring hook portion is provided on a left end portion of the release slide base 161 when seen in a direction F shown in FIG. 2. A protrusion 199*b* of an operating link 199, which is driven by a release driving arm 184 of the interlocking mechanism 180, is movable in the X-axis direction so as to contact or move away from a lower end portion of the release slide base 161. When the protrusion 199*b* is moved in a direction E2, a moving force in the direction E2 is applied to the release slide base 161.

The release pin 162 is provided on the right side of the upper looper shaft 36 when seen in the direction F shown in FIG. 2, and is protruded parallel to the upper looper shaft 36 from the end surface of the release slide base 161 toward the upper looper support arm 34. A length of the release pin 162 is set such that a tip of the release pin 162 is inserted into the slot 35*a* of the upper looper oscillating arm 35 through the hole 34*a* of the upper looper support arm 34 in a state in which the end surface of the release slide base 161 is in contact with the upper looper support arm 34, and such that the release pin 162 is disengaged from the upper looper oscillating arm 35 and is engaged only with the upper looper support arm 34 when the release slide base 161 is slid in the direction E2 by the interlocking mechanism 180. Accordingly, the release pin 162 is operable to switch a coupling and a decoupling between the upper looper support arm 34 and the upper looper oscillating arm 35, thereby switching an interlock and a release between the upper looper shaft 36 and the upper looper 31.

The coil spring 164 is externally provided on the upper looper driving arm 36 on an opposite side to the upper looper support arm 34 with the release slide base 161 interposed therebetween. The coil spring 164 has one end engaged with the other end surface of the release slide base 161 and the other end engaged with an end face of a coupling body 36*a* fixed to the upper looper shaft 36. The coil spring 164 constantly biases the release slide base 161 toward the upper looper support arm 34 (in a direction E1 shown in FIG. 2).

The second switching mechanism 160 couples the upper looper 31 and the upper looper shaft 36 when the release slide base 161 is positioned on a side of the direction E1, i.e., on a side of the upper looper support arm 34 so that the release pin 162 is inserted through the slot 34*a* of the upper looper support arm 34 and the slot 35*a* of the upper looper oscillating arm 35, while switches the upper looper 31 and the upper looper shaft 36 into a decoupled state when the release slide base 161 is positioned on a side of the direction E2 so that the upper looper oscillating arm 35 is decoupled from the upper looper support arm 34.

The second spring 163 has one end (an upper end) coupled to the spring hook portion of the release slide base 161 on the left side of the upper looper shaft 36 when seen in the direction F shown in FIG. 2, and the other end (a lower end) coupled to the inner bottom surface of the bed portion 2*b*. The second spring 163 is a tension spring, and constantly biases the release slide base 161 in a rotating direction around the upper looper shaft 36, i.e., a rearward moving direction of the upper looper 31 (a direction G shown in FIG. 2). The second spring 163 (the second moving means) moves the upper looper 31 to the lower position when the upper looper 31 is decoupled from the upper looper shaft 36 through a sliding movement of the release slide base 161. When the upper looper 31 and the upper looper shaft 36 are brought into a decoupled state by the second switching mechanism 160, the second spring 163 moves the upper looper 31 to a lowermost position of its vertical motion (a lower position) via the release slide base 161, the release pin 162 and the upper looper support arm 34. In the first exemplary embodiment, the thread hole 31*b* of the upper looper 31 becomes coincident with the blowing port 122*a* of the thread guiding pipe 122 positioned at the blowing position when the upper looper 31 is moved at the lower position. The lowermost position of the upper looper 31 is a threading position of the upper looper 31 (see FIG. 5).

The main shaft locking mechanism 170 includes a main shaft locking plate 171 fixed to the lower shaft 6, a support shaft 172 fixed to the bed portion 2*b*, an L-shaped link member 173 rotatable in a horizontal plane around the support shaft 172 in accordance with an input operation from the threading lever 144, and a main shaft locking member 174 rotatable in the horizontal plane around the support shaft 172 and placed on the link member 173.

The main shaft locking plate 171 is formed with a slit 171*a* (an engaging portion) with which the plate-shaped main shaft locking member 174 is engagable. The slit 171*a* formed on a part of an outer circumference of the main shaft locking plate 171 in a radial direction thereof. The slit 171*a* is provided at the predetermined rotating angle of the lower shaft 6 (the main shaft), i.e., the angle of the lower shaft 6 at which the main shaft locking member 174 becomes engagable when the mark m1 becomes coincident with the mark m2, the lower looper 21 interlocking with the lower shaft 6 is positioned at the front position in the back and forth movement thereof, and the upper looper 31 is positioned at the upper position in the vertical movement thereof.

The link member 173 is rotatably supported by the support shaft 172 fixed to the sewing machine frame 2 at a bent portion of the L-shape. A pin 173*a* is protruded in the Z-axis direction from an upper surface at one end of the link member 173, and is rotatably coupled to one end portion (a rear end portion) of the release link 182. A spring hook 173*b* is provided on the other end of the link member 173. When the release link 182 is moved in a direction B1 by the operation of the threading lever 144, the link member 173 is rotated around the support shaft 172 and a side on the other end portion becomes almost parallel to the lower shaft 6. A length of the side on the other end side of the link member 173 is set such that the link member 173 does not come in contact with the main shaft locking plate 171 when it is rotated around the support shaft 172.

The main shaft locking member 174 is a plate-shaped member, and is rotated in the horizontal plane around the support shaft 172 to be engaged with the slit 171*a* of the main shaft locking plate 171 (a rotating body) in the radial direction. A length of the main shaft locking plate 174 is set such that the main shaft locking plate 174 is engageable with an inner part of the slit 171*a* of the main shaft locking plate 171 when it is rotated around the support shaft 172 to be parallel to the lower shaft 6. A spring hook 174*a* is provided on one side of the main shaft locking member 174. One end of a tension spring 175 (biasing means) is coupled to having the spring hook 173*b* of the link member 173 and the other end of the tension spring 175 is coupled to the spring hook 174*a* of the main shaft locking member 174. The main shaft locking member 174 and the link member 173 form a two-layer structure in which they are rotatable separately around the same axis. The main shaft looking member 174 is constantly biased toward the spring hook 173*b* by an biasing force of the tension spring 175.

The interlocking mechanism 180 includes the driving link 183 for moving the release slide base 151 of the first switching mechanism 150 in the X-axis direction, the driving link 184 for moving the release slide base 161 of the second switching mechanism 160 in the X-axis direction, and the release link 182 for coupling the driving links 183, 184 to the operating plate 142 of the moving mechanism 140 and the link member 173 of the main shaft locking mechanism 170 (see FIG. 2).

As shown in FIG. 2, the release link 182 extends in the Y-axis direction, i.e., in the longitudinal direction of the sewing machine 1, at a lower area inside the bed portion 2*b*. The release link 182 is formed with slots 182*a*, 182 *b*, 182*c* and 182*d* which vertically penetrate therethrough. The slots 182*a*, 182*c* and 182*d* are formed at a rear end portion (a right end portion in FIGS. 1 and 2), an intermediate portion and a tip portion (a left end portion in FIGS. 1 and 2) of the release link 182 respectively, and extend in the X-axis direction. The slot 182*b* is formed at the intermediate portion of the release link 182 in a longitudinal direction thereof, and extends in the Y-axis direction.

The pin 173*a* protruded from the one end portion of the link member 173 is slidably engaged with the slot 182*a*, and a pin 181*a* protruded in the Z-axis direction from an upper surface of a release link base 181 fixed to the bottom surface inside the bed portion 2*b* is slidably engaged with the slot 182*b*. A pin 184*a* protruded from an upper surface at one end portion of the driving link 184 is slidably engaged with the slot 182*c*, and a pin 183*a* protruded from an upper surface at one end portion of the driving link 183 is slidably engaged with the slot 182*d*. The bent portion 142*a* of the operating plate 142 is fixed to the release link 182 with screws near the rear end portion of the release link 182, and the threading lever 144 on a tip of the bent portion 142*a* is inserted into the lever groove 9. A movement of the release link 182 in the X-axis direction is restricted by the slot 182*b* and the pin 181*a*, and a movement of the release link 182 in the Z-axis direction is restricted by the threading lever 144 and the lever groove 9. Accordingly, the release link is movable only the Y-axis direction.

As shown in FIG. 2, the driving link 183 has an L-shape when seen in a plan view, and a bent portion of the L-shape is rotatably supported by the bottom surface of the bed portion 2*b* via a shaft 183*c*. The protrusion 183*a* is upwardly provided on the end portion of the driving link 183, while the other protrusion 183*b* is upwardly provided on the other end portion of the driving link 183. The driving link 183 converts a movement of the release link 182 in the Y-axis direction into a movement in the X-axis direction, and transmits the X-axis movement to the release slide base 151.

As shown in FIG. 2, the driving link 184 has an L-shape when seen in a plan view, and a bent portion of the L-shape is rotatably supported by the bottom surface of the bed portion 2*b* via shaft 184*c*. A protrusion 184*a* is upwardly provided on the end portion of the driving link 184, while the other protrusion 184*b* is upwardly provided on the other end portion of the driving link 184.

In the first exemplary embodiment, an L-shaped operating link 199 is provided such that one side thereof is aligned with a side of the L-shape of the driving link 184 on a side of the protrusion 184*b*. A bent portion of the L-shape of the operating link 199 is rotatably supported via the shaft 184*c* supporting the driving link 184. The protrusion 199*b* is upwardly provided on an end portion of the operating link 199 on the side overlapping with the driving link 184. A sector-shaped operating link groove portion 199*a*, which vertically penetrates through the operating link 199, is provided at an intermediate portion of the operating link 199 on the side overlapping with the driving link 184, and the protrusion 184*b* of the driving link 184 is loosely fitted in the operating link groove portion 199*a*. The sector-shape of the operating link groove portion 199*a* has its center at the shaft 184*c*, and one of edges along a radial direction of the sector-shape is parallel to the side of the operating link 199.

As described above, the interlocking mechanism 180 interlocks the moving mechanism 140, the first and second switching mechanisms 150, 160, and the main shaft locking mechanism 170 via the release link 182, whereby the thread discharging port 112 of the thread conduit 110 at the front position becomes coincident with the thread hole 21*b* of the lower looper 21 at the rear position, the thread inserting port 111 of the thread conduit 110 at the front position becomes coincident with the blowing port 121*a* of the thread guiding pipe 121 at the blowing position, and the blowing port 122*a* of the thread guiding pipe 122 at the blowing position becomes coincident with the thread hole 31*b* of the upper looper 31.

[Upper Looper Use/Nonuse Switching Mechanism]

The upper looper use/nonuse switching mechanism 190 according to the first exemplary embodiment will be described in detail with reference to FIGS. 2 to 4.

As shown in FIG. 2, the upper looper use/nonuse switching mechanism 190 includes an upper looper switching knob shaft 192 supported rotatably in the X-axis direction inside the bed portion 2*b*, an upper looper switching knob 191 (second operating means) attached to one end of the upper looper switching knob shaft 192, a switching driving arm 193 attached to the other end of the upper looper switching knob shaft 192, a slide plate 194 movable in the Y-axis direction when the switching driving arm 193 is turned, and a link mechanism 195 operable to convert the movement of the slide plate 194 in the Y-axis direction into a movement in the X-axis direction, and to transmit the movement in the X-axis direction to the release slide base 161.

The upper looper switching knob 191 is fixed to one end of the upper looper switching knob shaft 192 extending outside the sewing machine frame 2 on the side of the working position of the operator. A peripheral edge of the upper looper switching knob 191 is formed with a protruded portion 191*a* and concave portions 191*aa*, 191*ab* formed on respective sides of the protruded portion 191*a* for switching and holding a rotating position of the upper looper switching knob 191 between an upper looper use position at which the upper looper 31 and the upper looper shaft 36 are brought into a coupled state and an upper looper nonuse position at which the upper looper 31 and the upper looper shaft 36 are brought into a decoupled state. The upper looper switching knob 191 is operable to switch the coupling and the decoupling only in relation to the switching means 160 to switch the use and nonuse of the upper looper 31. A plate spring 191*b* has a base end attached to the sewing machine frame 2 and a tip portion bent to in a convex shape toward the peripheral edge of the upper looper switching knob 191. The bent portion 199*bb* of the plate spring 191*b* is in pressure contact with the protruded portion 191*a*. Together with the rotating positions of the upper looper switching knob 191 at which the respective concave portions 191*aa*, 191*ab* engage with the bent portion 199*bb*, a stitching pattern which requires the use of the upper looper 31 and a stitching pattern which does not require the use of the upper looper 31 are indicated on the sewing machine frame 2.

The other end of the upper looper switching knob shaft 192 is detachably fixed to an upper portion of the switching driving arm 193 with a screw, and a pin 193*a* extending in the X-axis direction is provided at a lower portion of the switching driving arm 193. When the upper looper switching knob shaft 192 is rotated, the pin 193*a* moves substantially along the Y-axis direction.

The slide plate 194 includes an upright portion which is parallel to a Z-Y plane. The upright portion of the slide plate 194*a* is formed with slots 194*a*, 194*b* penetrating therethrough in the X-axis direction. The slot 194*a* extends in the Y-axis direction, and the slot 194*b* extends in the Z-axis direction on a lower side of the slot 194*a*. The pin 193*a* of the switching driving arm 193 is engaged with the slot 194*b* so as to be slidable in the vertical direction. The other end of the upper looper switching knob shaft 192 is inserted through the slot 194*a* and is rotatably supported. A lower end of the upright portion is bent at right angle in the horizontal direction, and has one end extended in the Y-axis direction (i.e., toward the left side when seen in the direction F shown in FIG. 2).

The link mechanism 195 includes driving links 196*a*, 196*b* which are rotatably coupled to each other via a shaft 196*c* extending in the Z-axis direction and are rotatably supported on the bottom surface of the bed portion 2*b* via the shaft 196*c*, a spring 197 (a tension spring) applying a tensile force between the driving links 196*a*, 196*b*, the L-shaped operating link 199 operable to apply the moving force in the X-axis direction from the protrusion 199*b* protruded from the end portion thereof to the release slide base 161, and a driving link 198 coupling the driving link 196*b* and the other end of the operating link 199.

The driving link 196*a* has one end coupled to the end portion of the extended portion of the slide plate 194 so as to be rotatable in the horizontal direction. The other end of the driving link 196*a* is coupled to an intermediate portion of the driving link 196*b* extending in the X-axis direction via the shaft 196*c* so as to be rotatable in the horizontal direction. A spring hook portion 196*d* is upwardly formed from one side of the driving link 196*a* (i.e., on a right side when seen in the direction F shown in FIG. 2), and one end of the spring 197 is coupled to the spring hook portion 196*d*. Another spring hook portion 196*e* is formed upwardly on one side of the driving link 196*b* (i.e., on a left side when seen in the direction F shown in FIG. 2) so as to be opposed to the spring hook portion 196*d* when the driving links 196*a*, 196*b* are disposed linearly in parallel to each other, and the other end of the spring 197 is coupled to the spring hook portion 196*e*. The spring hook portion 196*e* is engagable with the other side of the driving link 196*a*, thereby restricting a relative counterclockwise rotation of the driving link 196*a* with respect to the driving link 196*b* around the shaft 196*c* so that they are disposed linearly to each other (see FIG. 4).

The driving links 196*a*, 196*b* and the spring 197 function as a first power 6 non-transmitting mechanism (first disconnecting means) operable to prevent the switching between the coupling and the decoupling of the upper looper 31 and the upper looper shaft 36 by the operation input from the threading lever 144 (the first operating means) from being transmitted to the upper looper switching knob 191 (the second operating means). On the other hand, the operation link groove portion 199*a* functions as a second power non-transmitting mechanism (second disconnecting means) operable to prevent the switching between the coupling and the decoupling of the upper looper 31 and the upper looper shaft 36 by the operation input from the upper looper switching knob 191 (the second operating means) from being transmitted to the threading lever 144 (the first operating means).

[Threading Operation]

Next, description will be given to a threading operation to be carried out in the sewing machine 1 having the above configuration.

During the stitching work, the operating lever 144 is positioned on a side of a direction B2, and the upper looper switching knob 191 is positioned on a side of a direction H2. Accordingly, the operating plate 142, the thread guiding pipes 121, 122 supported by the operating plate 142, and the release link 182 coupled to the operating plate 142 are also positioned on the side of the direction B2. Thus, the thread guiding pipes 121, 122 are positioned at the standby positions, and the link member 173 and the main shaft locking member 174 are separated from the main shaft locking plate 171 so that the lower shaft 6 is unlocked. Further, the release slide base 151 is positioned on the side of the direction C1 and the release slide base 161 is positioned on the side of the direction E1, so that the lower looper driving arm 24 and the lower looper support arm 23 are coupled to each other through the release pin 152, and the upper looper shaft 36 and the upper looper support arm 34 are coupled to each other through the release pin 162. Therefore, the lower shaft 6 is rotatable in synchronization with the sewing machine motor, and the lower looper 21 and the upper looper 31 are oscillatable in synchronization with the rotation of the lower shaft 6. The sewing operation is carried out by a cooperation of the needle 4, the lower looper 21 and the upper looper 31.

When inserting the lower looper thread T1 through the thread hole 21*b* of the lower looper 21 and the upper looper thread T2 through and the thread hole 31*b* of the upper looper 31 respectively, the sewing machine 1 is stopped and the flywheel 7 is manually rotated by the operator to adjust the mark m1 to be coincident with the mark m2, whereby the rotating angle of the lower shaft 6 is set the predetermined rotating angle, i.e., the angle of the lower shaft 6 at which the needle 4 is positioned at the upper position in the vertical motion thereof, the lower looper 21 is positioned at the foremost position (the front position) in the back and forth movement thereof, and the upper looper 31 is positioned at the upper position in the vertical motion thereof. Further, the main shaft locking member 174 becomes engagable in the radial direction with the engaging portion 171*a* of the main shaft locking plate 171 fixed to the lower shaft 6.

Next, when the threading lever 144 is manually moved in the direction B1 by the operator, the release link 182 is moved in the direction B1. If the lower shaft 6 is correctly positioned at the predetermined rotating angle at which the marks m1 and m2 are coincident with each other, the link member 173 and the main shaft locking member 174 becomes parallel to the lower shaft 6 so that the main shaft locking member 174 is fitted into the slot 171*a* of the main shaft locking plate 171, whereby the rotation of the lower shaft 6 is locked. On the other hand, when the threading lever 144 is moved in the direction B1 in a state in which the rotating angle of the lower shaft 6 is displaced from the predetermined rotating angle at which the marks m1 and m2 are coincident with each other, the main shaft locking member 174 abuts on a circumferential edge of the main shaft locking plate 171 where the slit 171*a* is not formed so that only the link member 173 becomes parallel to the lower shaft 6. A tip portion of the main shaft locking member 174 is biased toward a center of the main shaft locking plate 171 by the biasing force of the tension spring 175. When the lower shaft 6 is further rotated in this state until the lower shaft 6 is positioned at the predetermined rotating angle, the main shaft locking member 174 engages with the engaging portion 171*a*, whereby the rotation of the lower shaft 6 is locked. When releasing the locking state of the lower shaft 6, the threading lever 144 is manually moved in the direction B2 by the operator so that the release link 182 is moved in the direction B2, whereby the link member 173 and the main shaft locking member 174 are rotated in a direction separating from the main shaft locking plate 171.

On the other hand, inside the bed portion 2*b* below the needle 4, when the release link 182 coupled to the operating plate 142 is moved in the direction B1, the driving link 183 is rotated around the protrusion 183*c* in a clockwise direction when seen in a plan view. Then, the release slide base 151 is moved in the direction C2 against the biasing force of the coil spring 154. In the sewing machine 1 according to the first exemplary embodiment, furthermore, the driving link 184 is rotated around the protrusion 184*c* in the clockwise direction when seen in a plan view when the release link 182 is moved in the direction B1. Then, the protrusion 184*b* of the driving link 184 abuts on the edge portion of the operating link groove portion 199*a* and pushes the edge portion, whereby the operating link 199 is rotated around the protrusion 184*a* in the clockwise direction when seen in a plan view. Accordingly, the release slide base 161 is moved in the direction E2 against the biasing force of the coil spring 164 by the protrusion 199*b* of the operating link 199.

Figure 3:
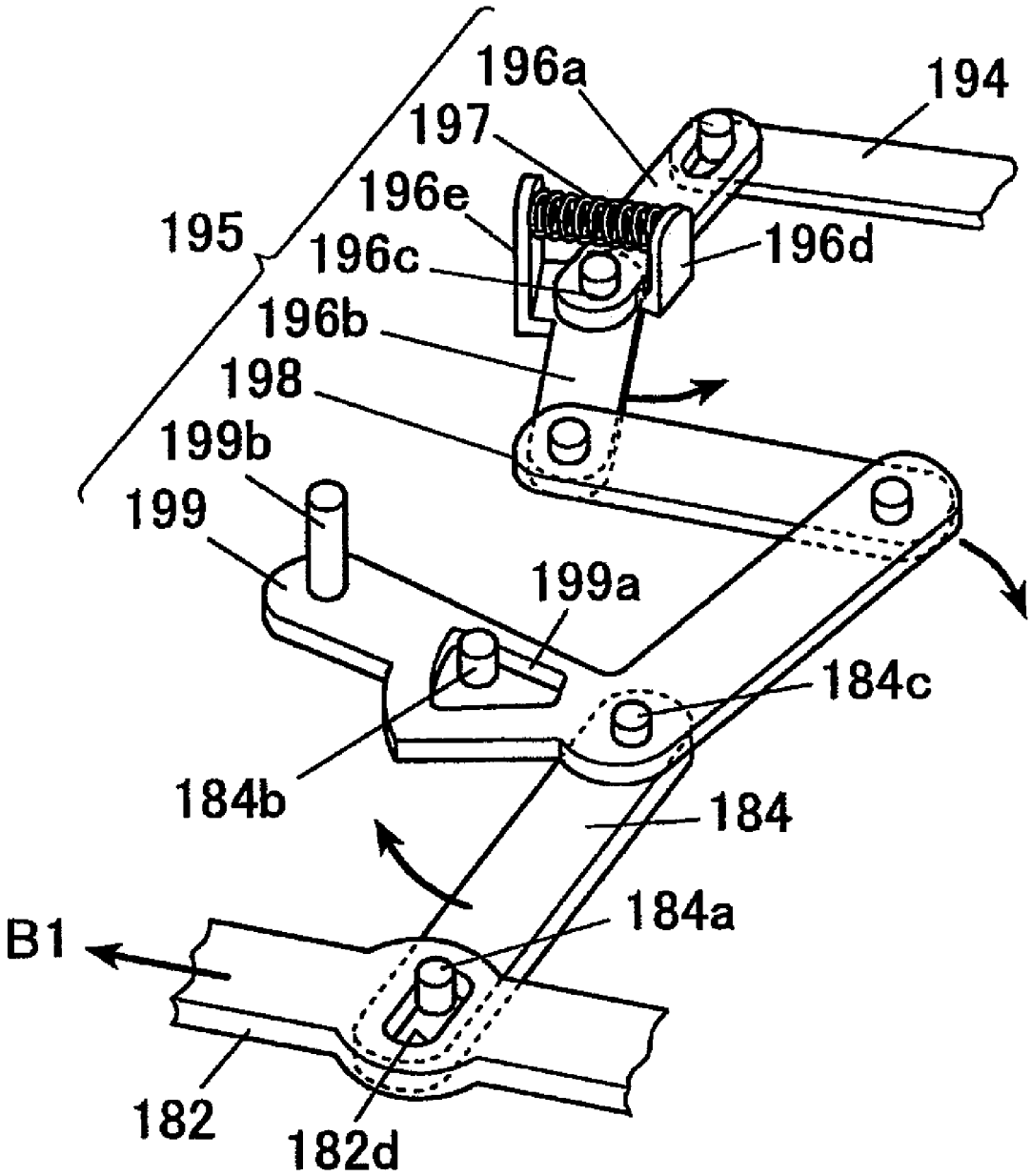
FIG. 3 is a perspective view of the upper looper use/nonuse switching mechanism in a state in which a threading lever is operated.
Figure 4:
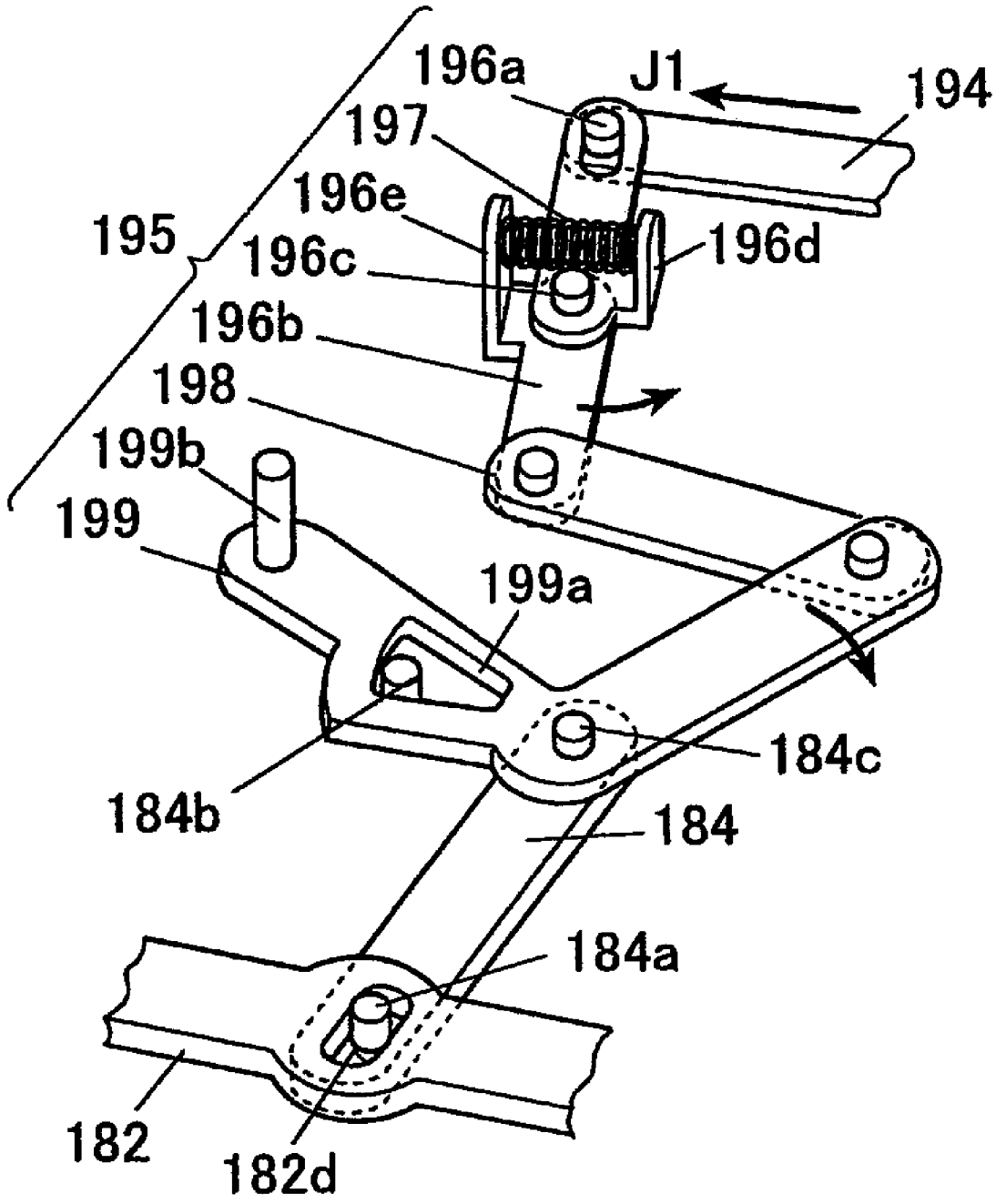
FIG. 4 is a perspective view showing the upper looper use/nonuse switching mechanism in a state in which an upper looper switching knob is operated.

When the operating link 199 is rotated in the clockwise direction as shown in FIG. 3, the end portion of the driving link 196*b* is moved substantially in the direction B2 via the driving link 198 coupled to the other end of the operating link 199. More specifically, the driving link 196*b* is rotated around the shaft 196*c* in the counterclockwise direction when seen in a plan view. However, because the protruded portion 191*a* of the upper looper switching knob 191 is held at the upper looper use position and the front-and-rear movement of the slide plate 194 is restricted, there is a high resistance for rotating the driving link 196*a*. Therefore, the spring 197 laid between the spring hooks 196*d*, 196*e* of the driving links 196*a*, 196*b* is extended and the driving link 196*b* becomes titled with respect to the driving link 196*a* (see FIG. 3). Because the driving links 196*a*, 196*b* are coupled in the vertical direction via the shaft 196*c*, a force transmitted from the operating link 199 when the operating link 199 is rotated in the clockwise direction is discharged. Consequently, the rotation of the operating link 199 from the operation of the threading lever 144 is not transmitted to the upper looper switching knob 191.

When the release slide base 151 is moved in the direction C2, the tip portion of the release pin 152 is pulled out from the slot 24*a* of the lower looper driving arm 24 and is thus inserted only into the slot 23*a* of the lower looper support arm 23. In other words, in this state, the coupling of the lower looper driving arm 24 and the lower looper support arm 23 is released and is thus brought into the decoupled state. The lower looper support arm 23 and the release slide base 151 are rotatable with respect to the lower looper shaft 22. Therefore, the release slide base 151 and the lower looper support arm 23 are rotated (tilted) in a direction A by the biasing force of the first spring 153. When the lower looper support arm 23 is rotated in the direction A, the lower looper 21 supported by the lower looper support arm 23 is positioned at the rear position so that the thread discharging port 112 of the thread conduit 110 becomes coincident with the thread hole 21*b* (see FIG. 5). When the lever portion 132 of the air pump 130 is operated in this state, the lower looper thread T1 is inserted through the thread hole 21*b* of the lower looper 21 via the thread conduit 110.

When the release slide base 161 is moved in the direction B2, the tip portion of the release pin 162 is pulled out of the slot 35*a* of the upper looper oscillating arm 35 and is thus inserted only into the slot 34*a* of the upper looper support arm 34. In other words, in this state, the coupling of the upper looper oscillating arm 35 and the upper looper support arm 34 is released and is thus brought into the decoupled state. The upper looper support arm 34 and the release slide base 161 are rotatable with respect to the upper looper shaft 36. Therefore, the release slide base 161 and the upper looper support arm 34 are rotated (tilted) in a direction G by the biasing force of the second spring 163. When the upper looper support arm 34 is rotated in the direction % the upper looper 31 supported on the upper looper support arm 34 is positioned at the lower position so that the thread hole 31*b* of the upper looper 31 becomes coincident with the blowing port 122*a* of the thread guiding pipe 122 (see FIG. 5). When the lever portion 132 of the air pump 130 is operated in this state, the upper looper thread T2 is inserted through the thread hole 31*b* of the upper looper 31.

[Looper Returning Operation]

Next, description will be given to an operation for returning the lower looper 21 tilted to the rear position and the upper looper 31 moved downward to the lower position so as to be interlocked with the lower shaft 6.

When the operating lever 144 is manually operated by the operator to move the operating plate 142 in the direction B2, the main shaft locking member 174 slips out of the engaging portion 171*a* so that the locking state of the lower shaft 6 is released. Consequently, the lower shaft 6 becomes rotatable. Further, the operating plate 142 is moved in the direction B2 so that the driving links 183, 184 are rotated in the counterclockwise direction when seen in a plan view through the release link 182. Consequently, the protrusion 183*b* moves away from the end surface of the release slide base 151 so that the release slide base 151 becomes movable in the direction C1. Similarly, the protrusion 199*b* moves away from the end surface of the release slide base 161 so that the release slide base 161 becomes movable in the direction E1.

When the lower looper 21 is tilted to the rear position, the tip portion of the release pin 152 is not coincident with the slot 24*a* of the lower looper driving arm 24. Thus, the release slide base 151 is biased in the direction C1 by the biasing force of the coil spring 154 and stands by in a state in which the tip of the release pin 152 passes through the slot 23*a* of the lower looper support arm 23 and abuts on a side wall of the lower looper driving arm 24 on a side opposing the lower looper support arm 23. Similarly, when the upper looper 31 is moved downward to the lower position, the tip portion of the release pin 162 is not coincident with the slot 35*a* of the upper looper oscillating arm 35. Thus, the release slide base 161 is biased in the direction E1 by the biasing force of the coil spring 164 and stands by in a state in which the tip of the release pin 162 passes through the slot 34*a* of the upper looper support arm 34 and abuts on a side wall of the upper looper oscillating arm 35 on a side opposing the upper looper support arm 34.

When the flywheel 7 is manually rotated by the operator, subsequently, the lower looper shaft 22 is rotated interlockingly with the rotation of the lower shaft 6 and the lower looper driving arm 24 is oscillated interlockingly with the rotation of the lower looper shaft 22. When the lower looper driving arm 24 is oscillated to one end in the oscillation (to the rearmost position in the back and forth movement of the lower looper 21), the slot 24*a* and the release pin 152 become coincident with each other, whereby the release slide base 151 is moved in the direction C1 by the biasing force of the coil spring 154 and the release pin 152 is inserted through the slot 24*a*. Consequently, the lower looper driving arm 24 and the lower looper support arm 23 are coupled to each other via the release pin 152. Accordingly, the lower looper 21 and the lower shaft 6 are brought into the coupled state and are interlocked with each other, so that the sewing work can be carried out.

When the flywheel 7 is rotated manually by the operator, similarly, the upper looper shaft 36 is rotated interlockingly with the rotation of the lower shaft 6 and the upper looper oscillating arm 35 is oscillated interlockingly with the rotation of the upper looper shaft 36. When the upper looper oscillating arm 35 is oscillated to one end in the oscillation (the lowermost position in the vertical motion of the upper looper 31), the slot 35*a* and the release pin 162 become coincident with each other, whereby the release slide base 161 is moved in the direction E1 by the biasing force of the coil spring 164 and the release pin 162 is inserted through the slot 35*a*. Consequently the upper looper oscillating arm 35 and the upper looper support arm 34 are coupled to each other through the release pin 162. Accordingly, the upper looper 31 and the lower shaft 6 are brought into the coupled state and are thus interlocked with each other, so that the sewing work can be carried out.

[Upper Looper Use/Nonuse Switching Operation]

Next, description will be given to an operation for switching the use and nonuse of the upper looper from the upper looper switching knob 191.

When the upper looper switching knob 191 is rotated in a direction H2 shown in FIG. 2 to be positioned at the upper looper use position, the switching driving arm 193 is disposed almost along the vertical direction through the upper looper switching knob shaft 192. In this state, the driving links 196*a*, 196*b* coupled to the slide plate 194 are linearly disposed with each other substantially in the X-axis direction. The respective sides of the L-shaped operating link 199 and the driving link 184 are disposed along the X-axis direction or the Y-axis direction. The release slide base 161 is disposed on the side of the upper looper support arm 34 by the biasing force of the coil spring 164, and the upper looper support arm 34 and the upper looper oscillating arm 35 are coupled through the release pin 162. Namely, when the upper looper switching knob 191 is disposed in the upper looper use position, the upper looper 31 is coupled to the upper looper shaft 36.

When the upper looper switching knob 191 is rotated in a direction H1 shown in FIG. 2 to be positioned at the upper looper nonuse position, the switching driving arm 193 is rotated in the clockwise direction through the upper looper switching knob shaft 192. Consequently, the slide plate 194 is moved in a direction J1 shown in FIG. 2 via the pin 193*a*. As a result, as shown in FIG. 4, the driving link 196*a* is rotated around the shaft 196*c* in the counterclockwise direction when seen in a plan view. When the driving link 196*a* is thus rotated, a rotational force is applied to the driving link 196*b* through the spring hook portion 196*e*, and the driving link 196*b* is rotated around the shaft 196*c* in the counterclockwise direction when seen in a plan view while keeping the driving link 196*b* and the driving link 196*a* to be linearly disposed to each other (see FIG. 4). The rotational force is applied to the operating link 199 via the driving link 198 so that the operating link 199 is rotated around the protrusion 184*c* in the clockwise direction when seen in a plan view. When the operating link 199 is rotated, a moving force in the direction E2 shown in FIG. 2 is applied to the release slide base 161 via the protrusion 199*b*.

In the first exemplary embodiment, the operating link groove portion 199*a* of the operating link 199 is formed to take the shape of the sector. Therefore, the rotational force of the operating link 199 is not transmitted to the protrusion 184*b* of the driving link 184. In other words, when the operating link 199 is rotated by the operation of the upper looper switching knob 191, a power is not transmitted to the driving link 184 so that the threading operation is not influenced.

When the release slide base 161 is moved in the direction E2, the release pin 162 is pulled out of the slot 35*a* of the upper looper oscillating arm 35 and is engaged only with the slot 34*a* of the upper looper support arm 34. As a result, the upper looper 31 is positioned at the lower position by the biasing force of the second spring 163. Namely, when the upper looper switching knob 191 is positioned at the upper looper nonuse position, the upper looper 31 is decoupled from the upper looper shaft 36.

Second Exemplary Embodiment

Next, a second exemplary embodiment of the invention will be described in detail with reference to FIGS. 6 to 16.

In the second exemplary embodiment, the same structures as those in the first exemplary embodiment have the same reference numerals, and repetitive explanation thereof will be omitted.

The second exemplary embodiment is different from the first exemplary embodiment in that there is provided a moving mechanism 240 supporting a thread guiding pipe 121 for inserting a lower looper thread T1 through a thread hole 21*b* of a lower looper 21 and a thread guiding pipe 122 for inserting an upper looper thread T2 through a thread hole 31*b* of an upper looper 31 at different heights. Further, according to the moving mechanism 240 of the second exemplary embodiment, a moving distance of the thread guiding pipe 122 is larger than that of the thread guiding pipe 121 (see FIG. 6). In the second exemplary embodiment, furthermore, driving links 283, 284 and a release link 282 are coupled to each other through arc-shaped slots 282*c*, 282*d* of the release link 282 (see FIG. 11).

Figure 6:
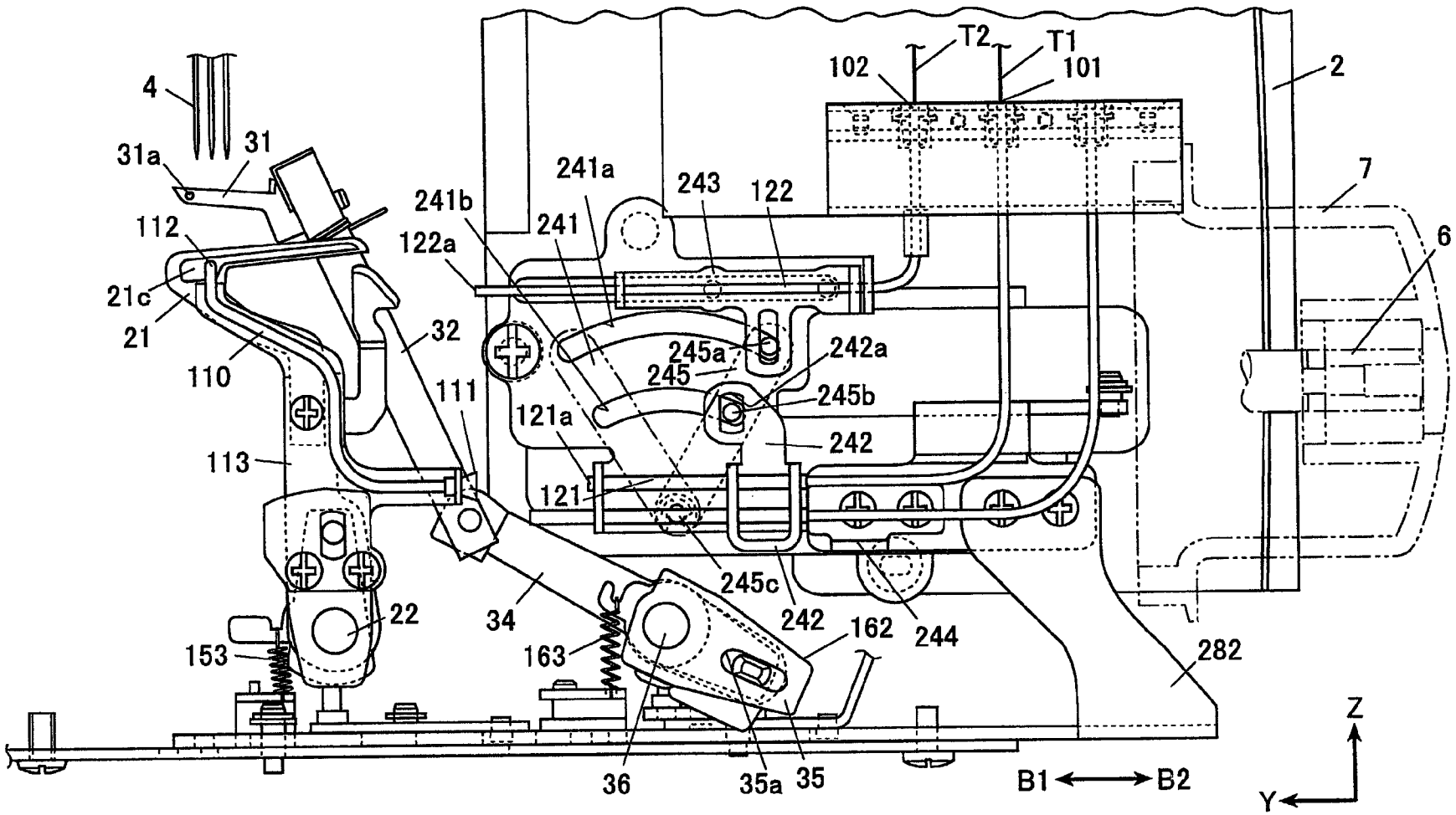
FIG. 6 is a schematic front view a threading device according to a second exemplary embodiment.
Figure 7:
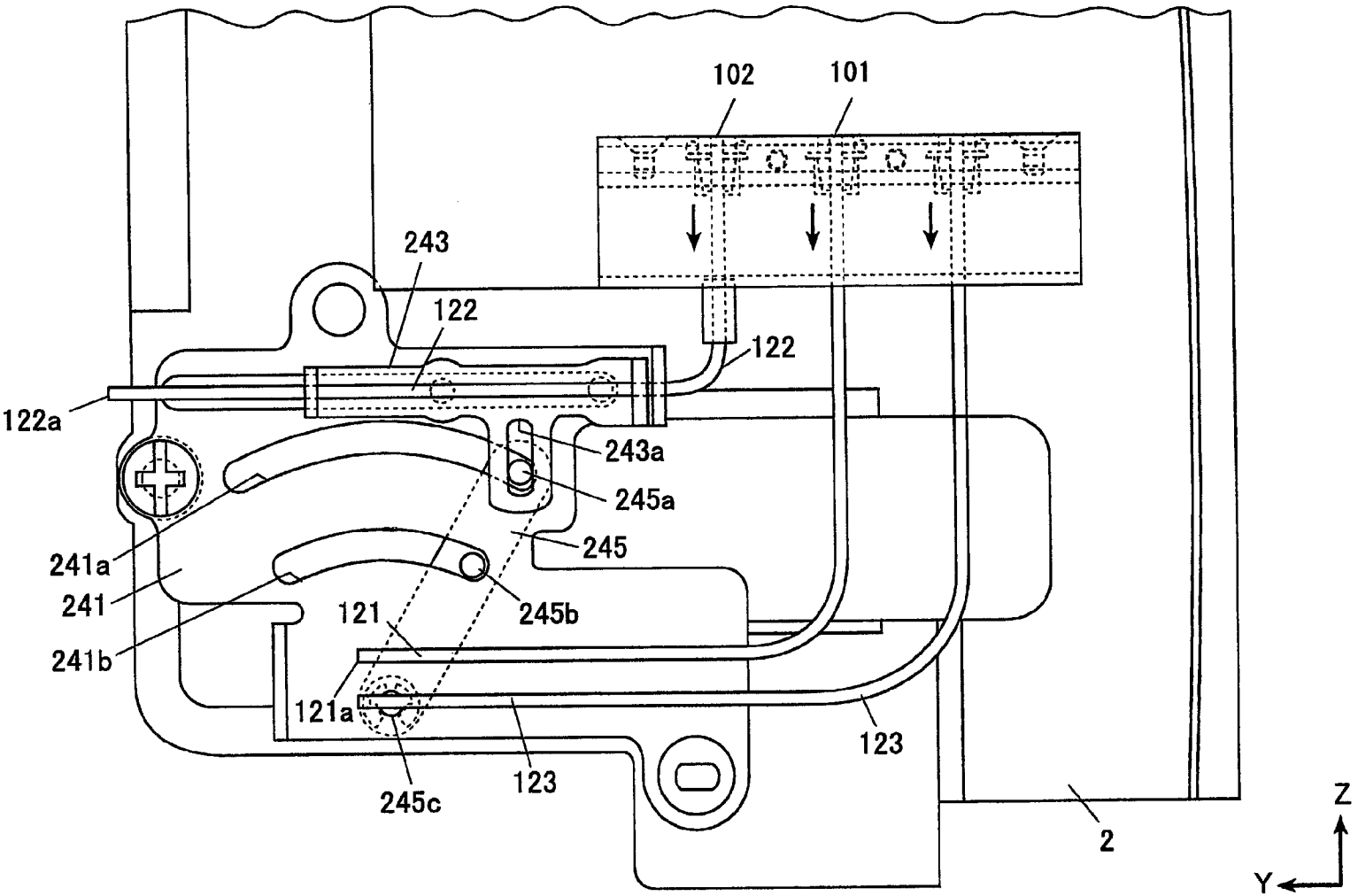
FIG. 7 is a schematic view showing an interlocking mechanism according to the second exemplary embodiment.
Figure 8:
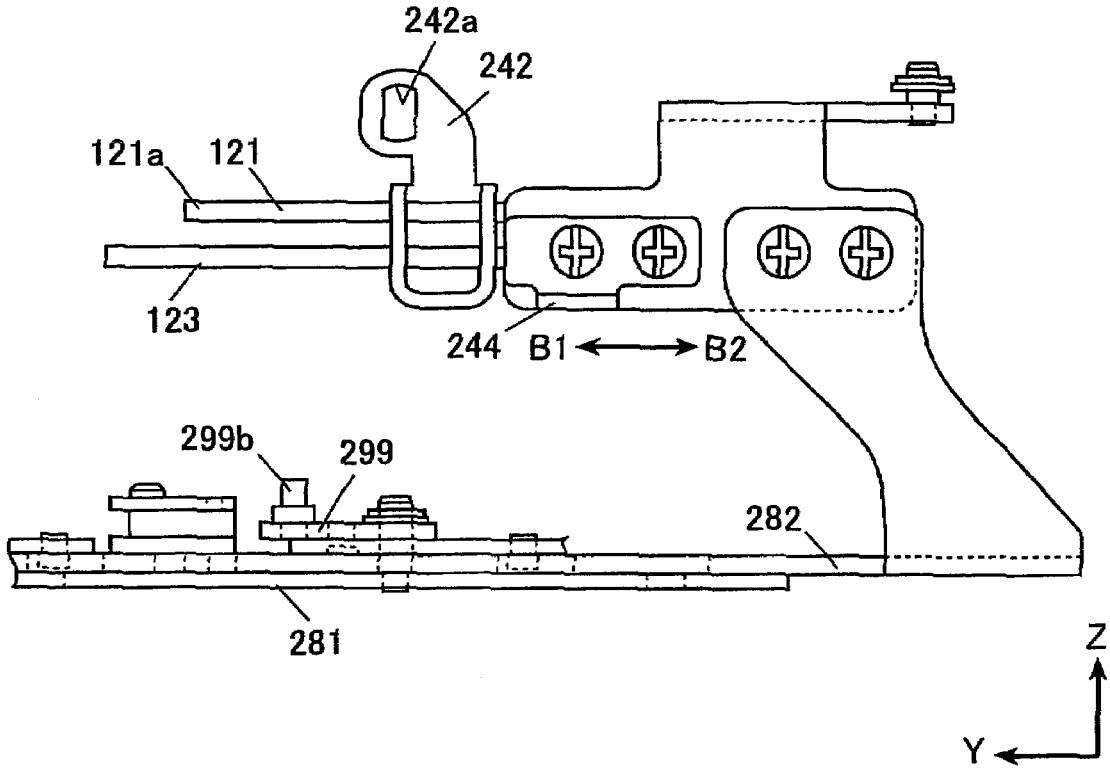
FIG. 8 is a schematic front view showing a moving mechanism of an air ejecting unit according to the second exemplary embodiment.
Figure 9:
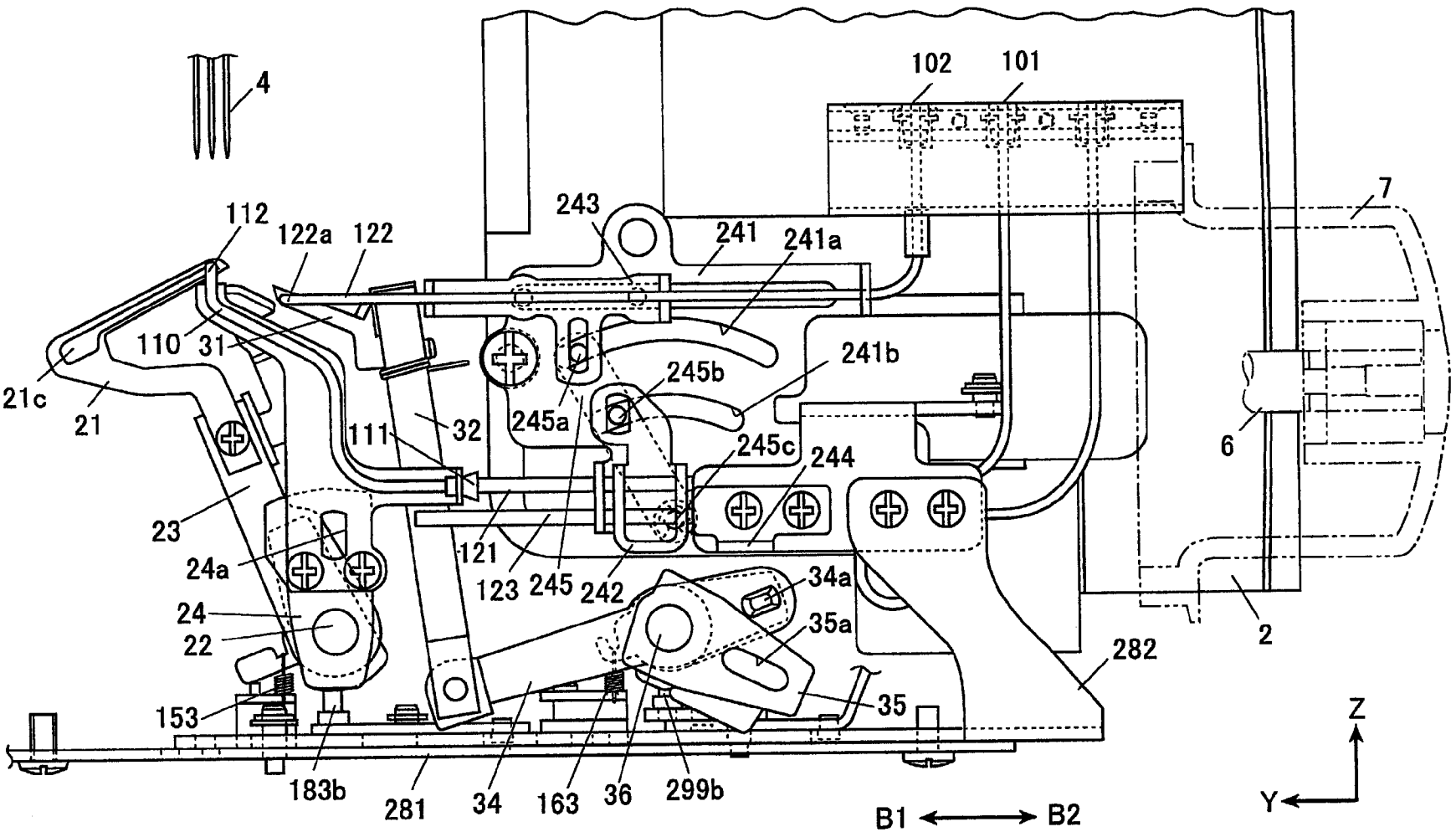
FIG. 9 is an explanatory front view showing an operation (between a threading position and a blowing position) of the threading device according to the second exemplary embodiment.

The moving mechanism 240 includes a holding member 242 holding the thread guiding pipe 121, through which the lower looper thread T1 is inserted, in the Y-axis direction, another holding member 243 holding the thread guiding pipe 122, through which the upper looper thread T2 is inserted, in the Y-axis direction, and a thread guide base 241 supporting the holding members 242, 243 such that the holding members 242, 243 are moveable in the Y-axis direction at different heights from each other (see FIGS. 6 to 8).

The thread guide base 241 is fixed inside a bed portion 2*b* parallel to a Y-Z plane. A link member 245 is coupled to the thread guide base 241 at a lower end portion thereof via a shaft 245*c* extending in the X-axis direction. The link member 245 is rotatable around the shaft 245*c* along a rear surface of the thread guide base 241 (a surface on a rear side of the paper in FIGS. 6 and 7). The thread guide base 241 is formed with slots 241*a*, 241*b*. The slots 241*a*, 241*b* are formed in a shape of concentric circular arcs having different radii from the shaft 245*c*.

The link member 245 includes a pin 245*b* at an intermediate portion in a longitudinal direction thereof. The pin 245*b* in inserted through the slot 241*b* and is movable along the slot 241*b*. The holding member 242 is coupled to the link member 245 via the pin 245*b* on a front surface side of the thread guide base 241.

The link member 245 further includes a pin 245*b* at an upper end portion thereof. The pin 245*b* is inserted through the slot 241*a* and is movable along the slot 241*a*. The holding member 243 is coupled to the link member 245 via the pin 245*a* on the front surface side of the thread guide base 241.

The holding member 242 is coupled to a part of the release link 282 (see FIGS. 6 and 8). When a threading lever 244 (first operating means) is operated, the release link 282 moves in the Y-axis direction together with the threading lever 244. The holding member 242 has a U-shaped holding portion supporting the thread guiding pipe 121 and an extended portion at an upper end portion thereof. The extended portion of the holding member 242 is formed with a slot 242*a* extending in the vertical direction. The holding member 242 is coupled to the intermediate portion of the link member 245 via the pin 245*b* slidably engaging with the slot 242*a*. A vertical length of the slot 242*a* is set so as to allow a vertical motion of the pin 245*b* while the pin 245*b* moves in the Y-axis direction along the circular arc slot 241*b*. When the release link 282 is moved in the Y-axis direction by the operation of the threading lever 244, the holding member 242 transmits the moving force in the Y-axis direction to the link member 245 to oscillate the link member 245 around the shaft 245*c*, and moves the thread guiding pipe 121 between a blowing position (see FIG. 9) and a standby position (see FIG. 6). In the second exemplary embodiment a thread guiding pipe 123 is also supported by the holding member 242 together with the thread guiding pipe 121. The thread guiding pipe 123 is for feeding a thread to be inserted through a double ring looper (not shown) with compressed air.

The holding member 243 holds the thread guiding pipe 122 in the Y-axis direction (see FIGS. 6 and 7). The holding member 243 is coupled to an upper portion of the thread guide base 241 such that a blowing port 122*a* of the thread guiding pipe 122 and a thread hole 31*a* of the upper looper 31 positioned at a lower position are at the same height. The holding member 243 is supported slidably in the Y-axis direction through the thread guide base 241. A lower portion of the holding member 243 is formed with a slot 243*a* penetrating therethrough in the X-axis direction. The slot 243*a* extends in the vertical direction. The holding member 243 is coupled to the upper end portion of the link member 245 via the pin 245*a* slidably engaging with the slot 243*a*. A vertical length of the slot 243*a* is set so as to allow a vertical motion of the pin 245*a* while the pin 245*a* is moved in the Y-axis direction along the circular arc slot 241*a*. When the release link 282 is moved in the Y-axis direction by the operation of the threading lever 244, the moving force in the Y-axis direction is transmitted to the holding member 243 through the holding member 242 and the link member 245, whereby the holding member 243 moves the thread guiding pipe 122 between a blowing position and a standby position.

Figure 11:
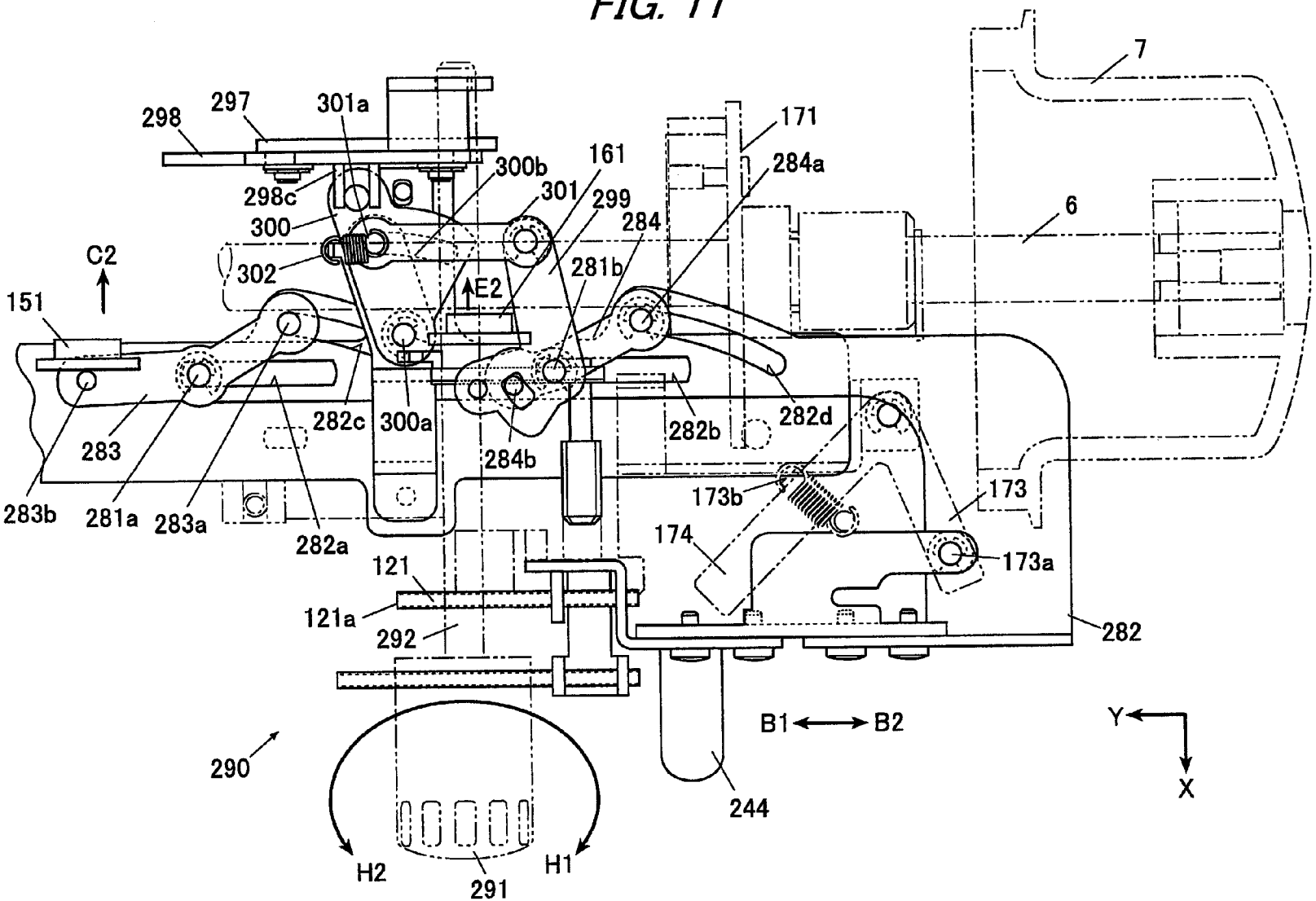
FIG. 11 is a schematic plan view of the upper looper use/nonuse switching mechanism according to the second exemplary embodiment.
Figure 12:
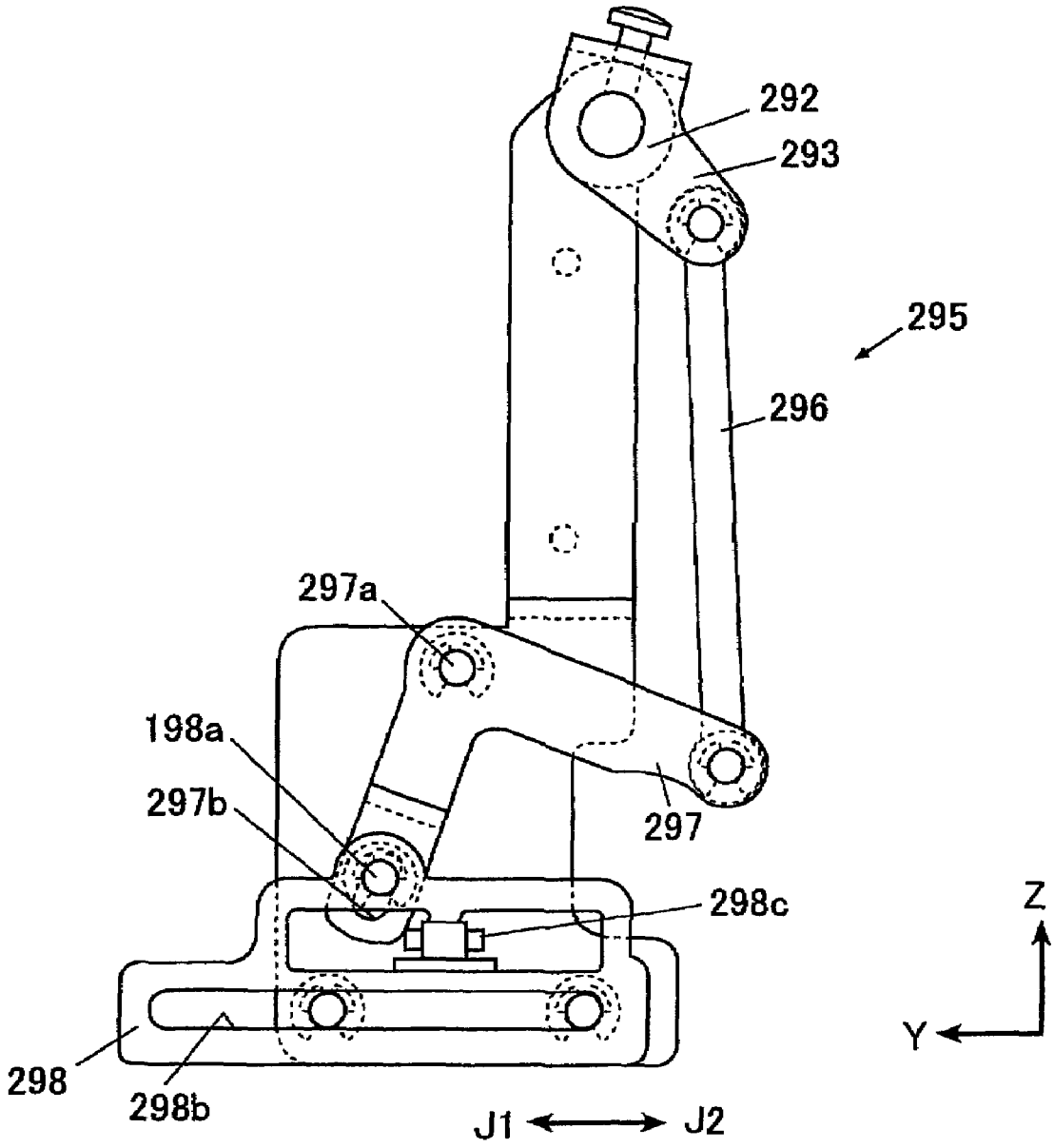
FIG. 12 is another front view of the upper looper use/nonuse switching mechanism according to the second exemplary embodiment.
Figure 13:
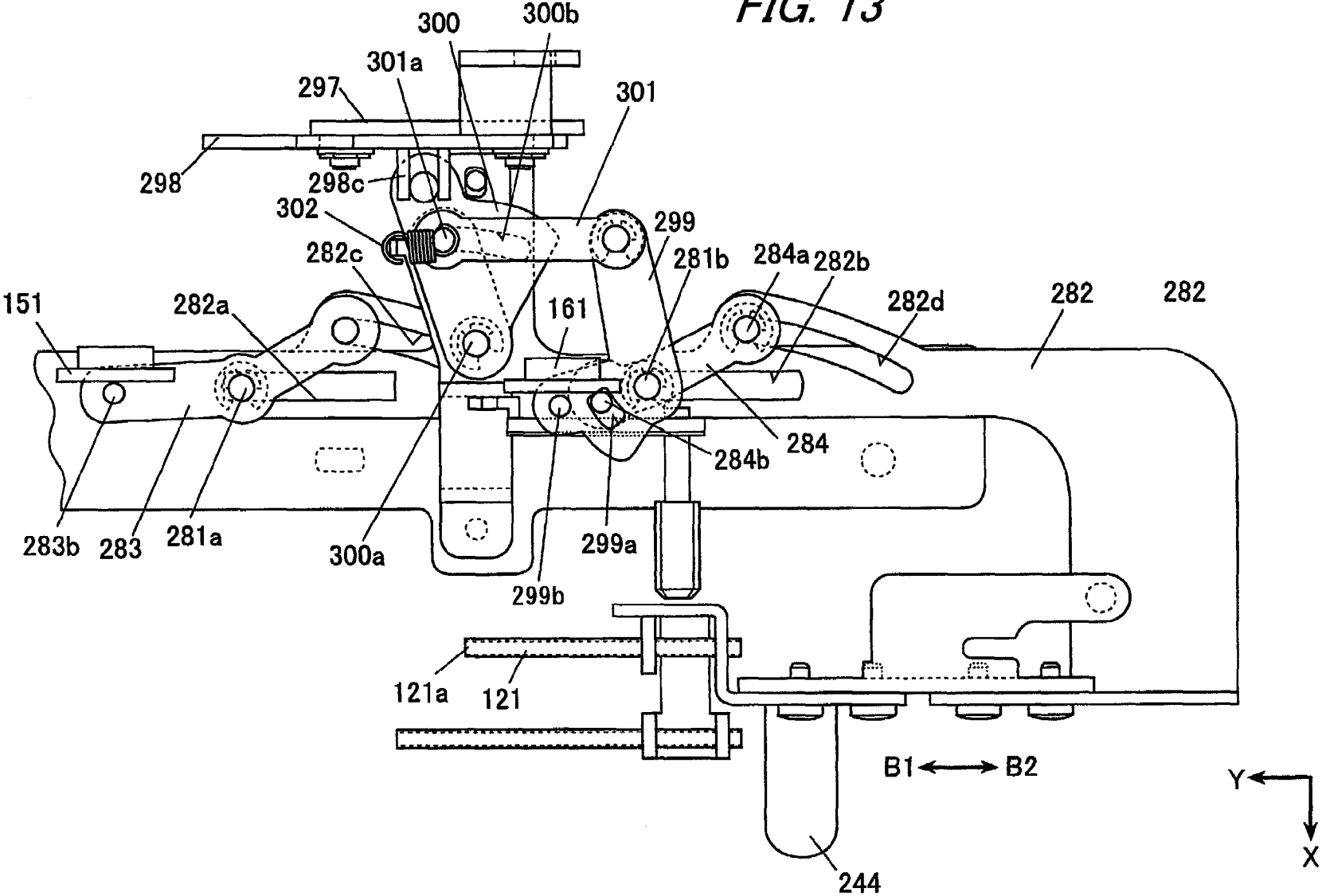
FIG. 13 is another plan view showing the upper looper use/nonuse switching mechanism according to the second exemplary embodiment.

As shown in FIGS. 6 and 11, the lease link 282 extends in a longitudinal direction of the bed portion 2*b* in a bottom area of the bed portion 2*b*. The release link 282 is formed with slots 282*a*, 282*b* extending in the Y-axis direction. A release base plate 281 is fixed to a bottom surface of the bed portion 2*b*, and includes shafts 281*a*, 281*b* protruding from an upper surface thereof. The shafts 281*a*, 281*b* are engaged with the slots 282*a*, 282*b*, respectively. The release link 282 is further formed with the slots 282*c*, 282*d*, each having the shape of the circular arc, for rotating the driving links 283, 284 in the horizontal direction. The driving links 283, 284 are operable to switch a coupling and a decoupling in the first and second switching mechanisms 150, 160, respectively. When the release link 282 is moved in a direction B1 (in a leftward direction in FIG. 11), the slots 282*c*, 282*d* rotate the driving links 283, 284 in a clockwise direction around the shafts 281*a*, 281*b* when seen in a plan view via pins 283*a*, 284*a* engaging with the slots 282*c*, 282*d* respectively. An intermediate portion of the link 284 and a bent portion of an operating link 299 having an L-shape are rotatably supported on the shaft 281*b* (see FIG. 16). A protrusion 284*b* is provided on an upper surface at one end portion of the driving link 284, and is loosely engaged with an operating link groove portion 299*a* formed on the operating link 299 in a shape of a sector (see FIGS. 13 and 16). Since a structure in which the driving link 284 is rotated to move a release slide base 161 in the X-axis direction via a protrusion 299*b* provided on an upper surface of the operating link 299 is the same as that in the first exemplary embodiment, description will be omitted. The threading lever 244 (the first operating means) has one end coupled to an upright portion at one end portion of the release link 282 (a right end portion in FIGS. 6 and 11), and the other end coupled to one end of a link member 173 of a main shaft locking mechanism 170 such that the link member 173 is rotatable in the horizontal plane. Consequently, the driving links 283, 284, the moving mechanism 240, the threading lever 244 and the main shaft locking mechanism 170 are coupled to each other via the release link 282, and the respective portions are interlocked with each other in accordance with the operation of the threading lever 244 in the Y-axis direction.

Next, description will be given to an upper looper use/nonuse switching mechanism 290 according to the second exemplary embodiment.

Figure 10:
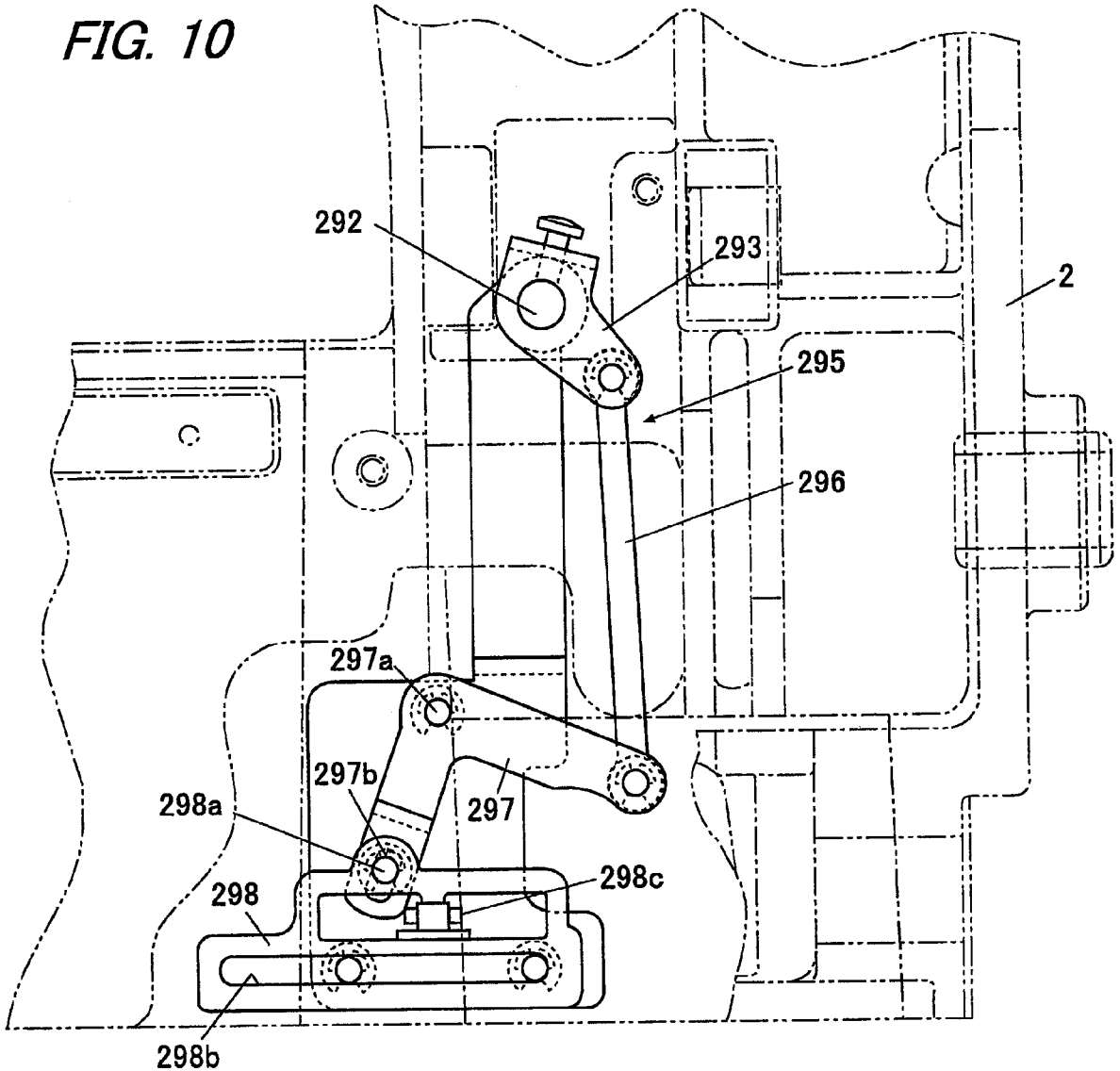
FIG. 10 is a schematic front view of an upper looper use/nonuse switching mechanism according to the second exemplary embodiment.

As shown in FIGS. 10 and 11, the upper looper use/nonuse switching mechanism 290 includes an upper looper switching knob shaft 292 supported rotatably around the X-axis direction inside the bed portion 2*b*, an upper looper switching knob 291 (second operating means) attached to one end of the upper looper switching knob shaft 292, a switching driving arm 293 attached to the other end of the upper looper switching knob shaft 292, and a link mechanism 295 operable to convert a turning movement of the switching driving arm 293 into a movement in the X-axis direction, and to transmit the movement to the release slide base 161.

As shown in FIG. 10, the switching driving arm 293 has one end fixed to the other end of the upper looper switching knob shaft 292 with a screw, and the other end of the switching driving arm 293 extends obliquely downward in a rightward direction in FIG. 10 when seen from a working position of an operator. An upper end of a link 296 of the link mechanism 295 is coupled to the other end of the switching driving arm 293 so as to be rotatable around the X-axis. One end of an L-shaped link 297 is coupled to a lower end of the link 296 so as to be rotatable around the X axis. The link 297 is rotatably supported on a sewing machine frame 2 via a shaft 297*a* extending along the X axis at a bent portion of the L-shape. The other end of the link 297 is formed with a slot 297*b* extending in a radial direction of the shaft 297*a*. A slider 298 is provided parallel to the Y-Z plane, and is coupled to the link 297 so as to be rotatable around the X axis via a shaft 298*a* inserted through the slot 297*b*. The slider 298 is formed with a slot 298*b* extending in the Y-axis direction at a lower portion thereof. Shafts are engaged into the slot 298*b* such that the slider 298 is movable in the Y-axis direction inside the bed portion 2*b*. When the upper looper switching knob 291 is rotated in a counterclockwise direction (a direction H2) from the state shown in FIGS. 10 and 12, the upper looper switching knob shaft 292 is rotated so that the switching driving arm 293 is rotated in the direction H2 shown in FIG. 14. Consequently, the L-shaped link 297 is turned in the counterclockwise direction via the link 296, whereby the slider 298 is moved in a rightward direction (a direction J2).

As shown in FIGS. 10 to 15, the slider 298 includes an extended portion 298*c* having a U-shape facing toward the working position of the operator, and a shaft extending in the Z-axis direction and provided on one end portion of a link 300 is fitted in the extended portion 298*c*. The other end of the link 300 is rotatably supported in the bed portion 2*b* via a shaft 300*a* extending in the Z-axis direction. A slot 300*b* having a shape of a circular arc around the shaft 300*a* is formed on the link 300, and a shaft 301*a* extending in the Z-axis direction is slidably engaged with the slot 300*b*. One end (a left end) of a link 301 provided substantially along the Y-axis direction and one end (a right end) of a coil spring 302 are coupled to the shaft 301*a*. The other end of the coil spring 302, on an opposite side to the link 301 (a left side in FIGS. 13 and 15), is engaged with the bed portion 2*b*. The other end of the link 301 is coupled to one end of the L-shaped operating link 299 so as to be rotatable in the horizontal plane. When the upper looper switching knob 291 is operated to rotate the upper looper switching knob shaft 292 (see FIG. 14), and the slider 298 is moved in the Y-axis direction through the links 296, 297 so that the L-shaped operating link 299 is rotated around the Z axis direction (see FIG. 15), whereby the coupling and the decoupling of the upper looper 31 and the upper looper shaft 36 is switched.

[Explanation of Operation]

Next, description will be given to a threading operation according to the second exemplary embodiment.

As shown in FIG. 6, when the threading lever 244 is positioned on a side of the direction B2, the main shaft locking mechanism 170 is released (see FIG. 11), and the thread guiding pipes 121, 122 are positioned at their standby positions. When a flywheel 7 is rotated to adjust the mark m1 to be coincident with the mark m2, the lower looper 21 and the upper looper 31 are positioned at the front position and the upper position, respectively (see FIG. 6).

When the threading lever 244 is moved in the direction B1 from this state, the link member 173 is rotated so that the main shaft locking mechanism 170 is brought into a locking state, and the release link 282 is moved in the direction B1. Consequently, the driving links 283, 284 are rotated around the shafts 281*a*, 281*b* in the clockwise direction when seen in a plan view along the slots 282*c*, 282*d* of the release link 282. Then, a release slide base 151 is moved in a direction C2 and the release slide base 161 is moved in the direction E2 so that both of the first and second switching mechanisms 150, 160 are brought into a decoupling state. Due to the biasing forces of the first and second springs 153, 163, therefore, the lower looper 21 and the upper looper 31 are positioned at the rear position and the lower position respectively. When the release link 282 is moved in the direction B1, moreover, a blowing port 121*a* of a thread guiding pipe 121 held by a holding member 242 is moved forward in the direction B1, and is thus positioned at the a blowing position opposing a thread inserting port 111 of a thread conduit 110 positioned at the front position (see FIG. 9). At the same time, the link member 245 is rotated in the counterclockwise direction around the shaft 245*c* when seen from a front through the holding member 242 and the pin 245*b*, and the blowing port 122*a* of the thread guiding pipe 122 is positioned at the blowing position opposing the thread hole 31*a* of the upper looper 31 through the pin 245*a* and the holding member 243 (see FIG. 9). The thread guiding pipe 122 held on at the upper end portion of the link member 245, which is rotated around the shaft 245*c* at the lower end portion thereof, is forwardly moved more greatly than the thread guiding pipe 121 held on the lower end portion of the link member 245. When the threading lever 244 is moved in the direction B2, a reverse operation to that described above is carried out. In other words, the lower looper 21 and the upper looper 31 are brought into a returnable state in which they are interlocked with the lower looper shaft 22 and the upper looper shaft 36 respectively, and the main shaft locking mechanism 170 is brought into a releasing state. Further, the thread guiding pipes 121, 122 are positioned at the standby positions (see FIG. 6).

Figure 14:
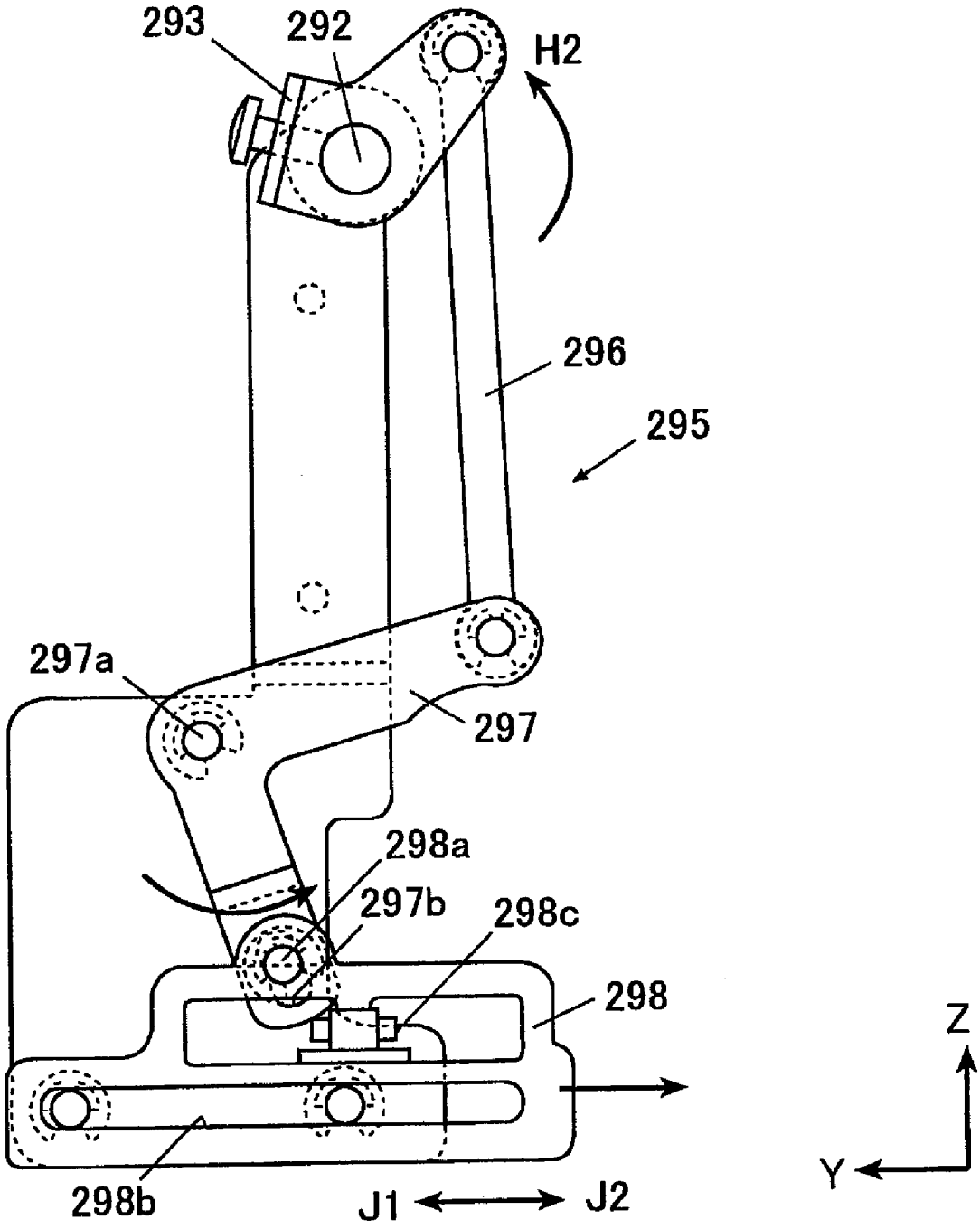
FIG. 14 is an explanatory view showing an operation of the upper looper use/nonuse switching mechanism according to the second exemplary embodiment.
Figure 15:
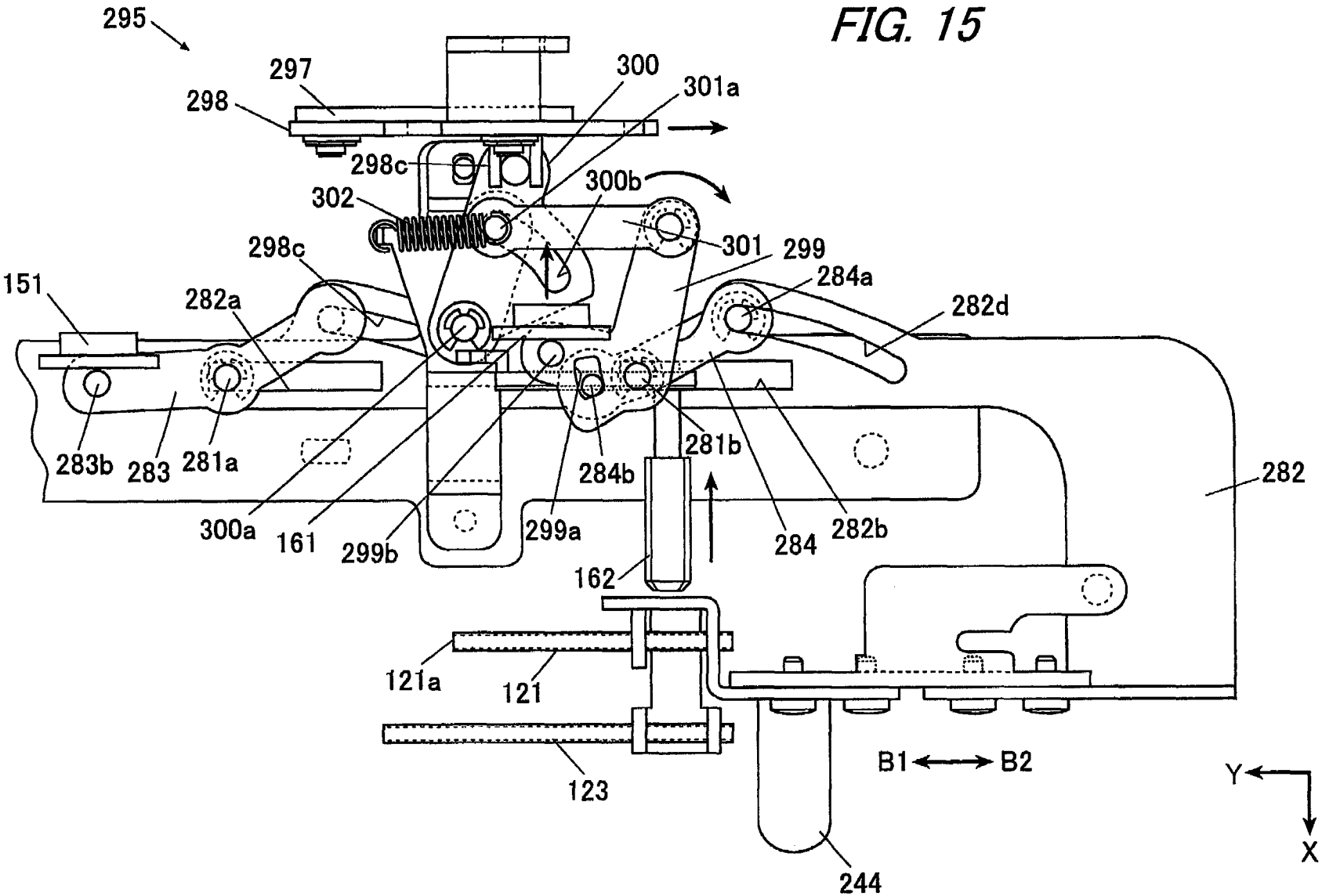
FIG. 15 is another explanatory view showing the operation of the upper looper use/nonuse switching mechanism according to the second exemplary embodiment.
Figure 16:
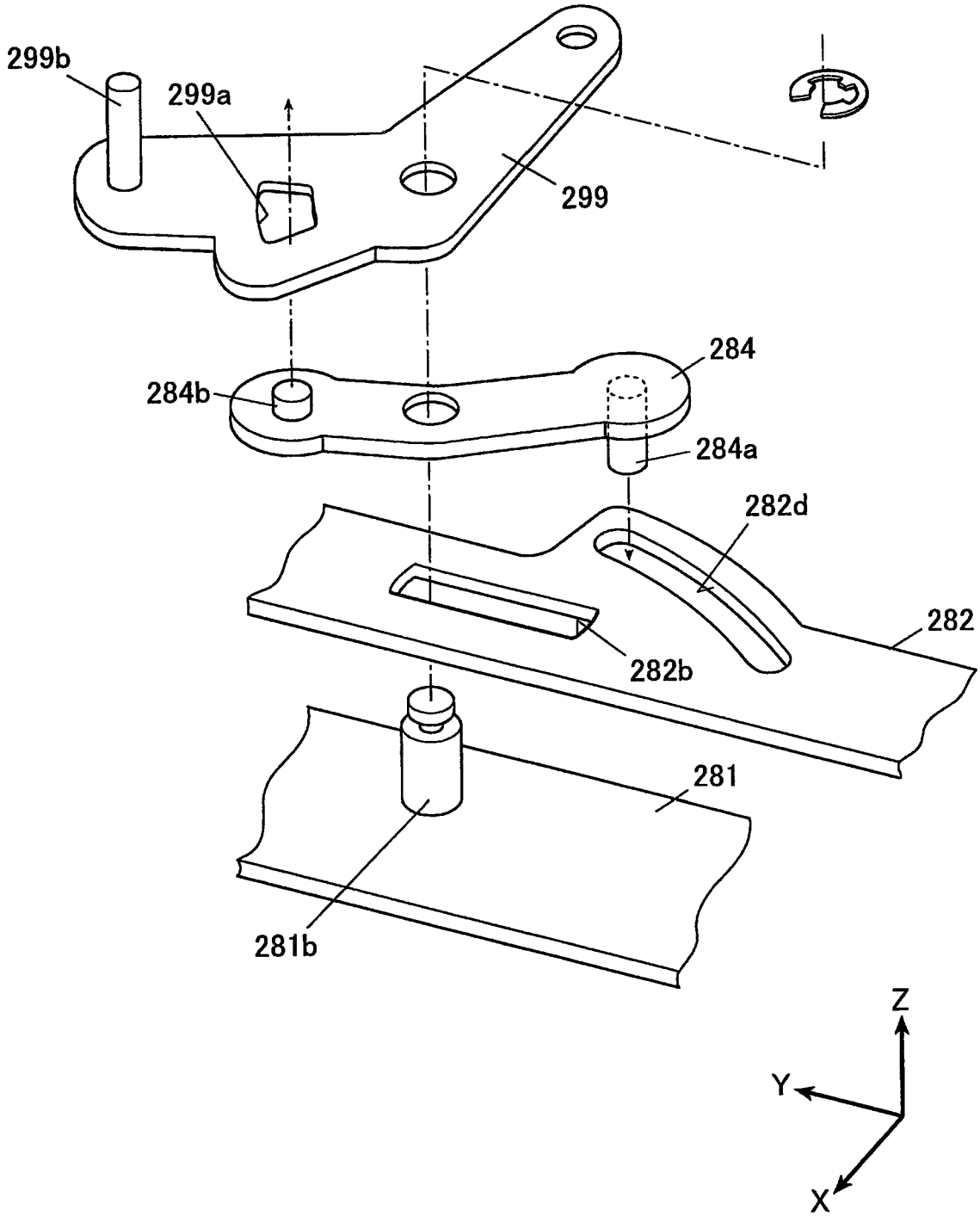
FIG. 16 is an exploded perspective view of a part of a coupling structure shown in FIG. 13.

Next, description will be given to the upper looper use/nonuse switching mechanism 290. When the upper looper switching knob 291 is positioned on a side of a direction H1, the link 296 is moved downward and the slider 298 is positioned on a left side in FIG. 12 (on a side of the direction J1) through the L-shaped link 297. Thus, the link member 299 is rotated in the counterclockwise direction when seen in a plan view shown in FIG. 13, and the second switching mechanism 160 is brought into the coupling state. On the other hand, when the upper looper switching knob 291 is rotated in the direction H2, the slider 298 is moved rightward (in the direction J2) as shown in FIG. 14 via the upper looper switching knob shaft 292, the switching driving arm 293, the link 296, and the L-shaped link 297. Consequently, the link member 299 is rotated through the links 300, 301 around the shaft 281*b* in the clockwise direction when seen in a plan view shown in FIG. 15. Thus, the second switching mechanism 160 is brought into the decoupling state.

As described above, according to the sewing machine of the second exemplary embodiment, the thread guiding pipes 121, 122 are retracted sufficiently rear so as not to disturb the sewing operation of the needle 4, the lower looper 21 and the upper looper 31 during the sewing work.

According to the sewing machine 1 of the exemplary embodiments, it is possible to interlock the air ejecting unit, the first and second switching mechanisms 150, 160, and the main shaft locking mechanism 170 by a single operation without separately operating each of the portions. Therefore, it is possible to considerably simplify the threading work. Specifically, by simply operating the threading lever 144, it is possible to move the air ejecting unit to the blowing position and to lock the lower shaft 6 at the predetermined rotating angle, and furthermore, to dispose the lower looper 21 and the upper looper 31 at the rear position and the lower position via the interlocking mechanism 180, respectively. In other words, it is possible to positioned the upper looper 31 at the lower position, which is suitable for the threading work, by the operation of the threading lever 144. Consequently, it is possible to considerably simplify the threading work, thereby carrying out the threading work easily. Moreover, the operator of the sewing machine 1 can align of the lower shaft 6, lock or unlock the lower shaft 6, move the thread guiding pipes 121, 122, tilt the lower looper 21, downwardly move the upper looper 31, or carry out returning operations by one hand without requiring both hands. Therefore, it is possible to considerably enhance an operability of the sewing machine 1. By tilting the lower looper 21 to the rear position, furthermore, the thread discharging port 112 of the thread conduit 110 becomes coincident with the thread hole 21*b* of the lower looper 21. Consequently, it is possible to carry out the threading work with a simple structure without requiring, for example, to pull the needle thread caught by the lower looper 21 or to release the tension of the needle thread. Furthermore, irrespective of the presence of the threading operation or the angle of the lower shaft 6, it is possible to switch the use and the nonuse of the upper looper 31 from the upper looper switching knob 191. In addition, it is possible to carry out the threading or returning operation by operating the threading lever 144 irrespective of whether the upper looper switching knob 191 is disposed at the upper looper use position or at the upper looper nonuse position. Therefore, it is possible to enhance the operability of the sewing machine 1. Moreover, the operation for decoupling the upper looper 31 from the upper looper shaft 36 by the upper looper switching knob 191 and the threading lever 144 is carried out by using the common second switching mechanism 160. Consequently, it is possible to simplify the structure, and to reduce a space, a cost, and the number of components required for the apparatus. Further, the switching of the coupling and the decoupling of the upper looper and the upper looper shaft from the operation input of the first operating means is not transmitted to the second operating means by the first disconnecting means, and furthermore, the switching of the coupling and the decoupling of the upper looper and the upper looper shaft from the operation input of the second operating means is not transmitted to the first operating means by the second disconnecting means. Thus, it is possible to smoothly carry out the threading operation and the operation for switching the use and nonuse of the upper looper by operating the first operating means or the second operating means as needed without influencing the other operating means. In addition, the upper looper switching knob 191 is disposed on the side of the operator working position outside the sewing machine frame 2. Therefore, it is possible to easily switch the use and nonuse of the upper looper 31 without an operation for opening and closing the sewing machine cover.

While description has been made in connection with exemplary embodiments of the present invention, those skilled in the art will understand that various changes and modification may be made therein without departing from the present invention. It is aimed, therefore, to cover in the appended claims all such changes and modifications falling within the true spirit and scope of the present invention.

What is claimed is:

1. A sewing machine comprising:

an upper looper formed with a thread hole at a tip portion thereof and disposed so as to be oscillatable;

an upper looper shaft which oscillates the upper looper between an upper position and a lower position;

switching means disposed in relation to the upper looper and the upper looper shaft such that the switching means is operable to switch a coupled state and a decoupled state between the upper looper and the upper looper shaft;

moving means for moving the upper looper, which has been decoupled from the upper looper shaft by the switching means, to the lower position;

a thread guiding pipe formed with a thread path through which an upper looper thread is insertable and having a thread discharging port, the thread guiding pipe being movable between a position, at which the thread discharging port is aligned with the thread hole of the upper looper in the lower position, and another position, at which the thread discharging port is moved away from the thread hole; and first operating means operable to decouple the upper looper and the upper looper shaft via the switching means, and to move the thread discharging port of the thread guiding pipe to the position at which the thread discharging port is aligned with the thread hole of the upper looper in the lower position.

2. The sewing machine according to claim 1, further comprising second operating means operable to switch a use and a nonuse of the upper looper by coupling or decoupling the upper looper and the upper looper shaft via the switching means.

3. The sewing machine according to claim 2, wherein the switching means comprises a link mechanism operable to transmit a power for switching the coupled state and the decoupled state between the upper looper and the upper lopper shaft in accordance with an operation of the first operating means or the second operating means, and wherein the link mechanism comprises:

first disconnecting means for not transmitting, to the second operating means, the switching of the coupled state and the decoupled state between the upper looper and the upper lopper shaft caused by the operation of the first operating means; and second disconnecting means for not transmitting, to the first operating means, the switching of the coupled state and the decoupled state between the upper looper and the upper lopper shaft caused by the operation of the second operating means.

4. The sewing machine according to claim 3, wherein the switching means further comprises:

a member slidable with respect to the upper looper shaft in an axial direction thereof; and a pin engagable and disengagable with the member in accordance with an axial movement of the member.

5. The sewing machine according to claim 2, wherein the switching means comprises:

a member slidable with respect to the upper looper shaft in an axial direction thereof; and a pin engagable and disengagable with the member in accordance with an axial movement of the member.

6. The sewing machine according to claim 1, wherein the switching means comprises:

a member slidable with respect to the upper looper shaft in an axial direction thereof; and a pin engagable and disengagable with the member in accordance with an axial movement of the member.

7. The sewing machine according to claim 1, wherein the moving means comprises an elastic member biasing the upper looper to move to the lower position when the upper looper is decoupled from the upper looper shaft by the switching means.

* * * * *